US012258964B2

(12) United States Patent
Yoo et al.

(10) Patent No.: US 12,258,964 B2
(45) Date of Patent: Mar. 25, 2025

(54) SCROLL COMPRESSOR

(71) Applicant: LG Electronics Inc., Seoul (KR)

(72) Inventors: Byungkil Yoo, Seoul (KR); Jungsun Choi, Seoul (KR); Seheon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/066,615

(22) Filed: Dec. 15, 2022

(65) Prior Publication Data

US 2023/0358232 A1 Nov. 9, 2023

(30) Foreign Application Priority Data

May 6, 2022 (KR) ..... 10-2022-0056182

(51) Int. Cl.
*F04C 18/02* (2006.01)
*F04C 29/00* (2006.01)

(52) U.S. Cl.
CPC ..... *F04C 18/0269* (2013.01); *F04C 18/0215* (2013.01); *F04C 18/0253* (2013.01);
(Continued)

(58) Field of Classification Search
CPC ..... F04C 18/0215; F04C 23/008; F04C 18/0269; F04C 18/0261; F04C 2240/60;
(Continued)

(56) References Cited

U.S. PATENT DOCUMENTS 4,477,238 A 10/1984 Terauchi
5,318,424 A * 6/1994 Bush ..... F04C 18/0269 418/150
(Continued)

FOREIGN PATENT DOCUMENTS

EP 0814266 A1 * 12/1997 ..... F04C 18/02
GB 2149857 A * 6/1985 ..... F01C 1/0215
(Continued)

OTHER PUBLICATIONS

WO-2018115426-A1, English language machine translation (Year: 2018).*
(Continued)

*Primary Examiner* — Wesley G Harris
(74) *Attorney, Agent, or Firm* — Fish & Richardson P.C.

(57) ABSTRACT

A scroll compressor is disclosed. The scroll compressor includes a rotating shaft coupling portion axially extending from a central portion of an orbiting end plate to radially overlap an orbiting wrap, such that an eccentric portion of a rotating shaft is coupled thereto, and a portion of the orbiting wrap may extend from an end surface of the rotating shaft coupling portion facing a fixed end plate. With the configuration, a distance between bearing reaction force and gas reaction force acting on the orbiting scroll can be reduced, to stabilize a behavior of the orbiting scroll and thus reduce back pressure, thereby decreasing friction loss between scrolls. Simultaneously, compression chambers can be formed even in a central portion of the orbiting scroll, which can increase a compression ratio and improve volumetric efficiency.

17 Claims, 16 Drawing Sheets

(52) U.S. Cl.
CPC ..... *F04C 18/0276* (2013.01); *F04C 29/0021* (2013.01); *F04C 29/0078* (2013.01); *F04C 2240/10* (2013.01); *F04C 2240/20* (2013.01); *F04C 2240/30* (2013.01); *F04C 2240/60* (2013.01)

(58) Field of Classification Search
CPC ..... F04C 29/12; F04C 2240/603; F04C 18/0246; F04C 18/0253; F04C 29/0021; F04C 29/0078; F01C 1/0215
See application file for complete search history.

(56) References Cited

U.S. PATENT DOCUMENTS

| | | | | |
|---|---|---|---|---|
| 5,336,068 | A | 8/1994 | Sekiya et al. | |
| 5,370,512 | A * | 12/1994 | Fujitani | F04C 18/0269 418/55.2 |
| 2002/0025268 | A1* | 2/2002 | Moroi | F04C 29/045 418/55.1 |
| 2017/0306963 | A1* | 10/2017 | Lee | F04C 18/0269 |
| 2021/0062809 | A1* | 3/2021 | Uekawa | F04C 18/0215 |
| 2021/0148361 | A1 | 5/2021 | Sato et al. | |

FOREIGN PATENT DOCUMENTS

| | | | | |
|---|---|---|---|---|
| JP | H04-166689 | | 6/1992 | |
| JP | H0571477 | | 3/1993 | |
| JP | H08326671 | | 12/1996 | |
| JP | 2000-329079 | | 11/2000 | |
| JP | 2004-340067 | | 12/2004 | |
| JP | 2006-037867 | | 2/2006 | |
| WO | WO-2014189240 | A1 * | 11/2014 | F01C 1/0215 |
| WO | WO-2018115426 | A1 * | 6/2018 | F01C 21/10 |

OTHER PUBLICATIONS

Extended European Search Report in European Appln. No. 23151105.6, mailed on Sep. 22, 2023, 7 pages.
Office Action in Korean Appln. No. 10-2022-0056182, mailed on Aug. 3, 2023, 14 pages (with English translation).

* cited by examiner

SCROLL COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2022-0056182, filed on May 6, 2022, the contents of which are incorporated by reference herein in their entirety.

TECHNICAL FIELD

The present disclosure relates to a scroll compressor.

BACKGROUND

A compressor applied to a refrigeration cycle such as a refrigerator or an air conditioner serves to compress refrigerant gas and transmit the compressed refrigerant gas to a condenser. A rotary compressor or a scroll compressor is mainly applied to an air conditioner. Recently, the scroll compressor is applied even not only to the air conditioner but also to a compressor for hot water supply that requires a high compression ratio than the air conditioner.

A scroll compressor may be classified as a hermetic compressor when a drive part (or motor part) and a compression part are disposed in one casing, while being classified as an open type compressor when those parts are independently disposed. Also, the scroll compressor may be classified as a top-compression type when the compression part is located above the drive part while being classified as a bottom compression type when the compression part is located below the drive part. Further, the scroll compressor may be classified as a low-pressure type when a spaced accommodating the drive part forms suction pressure, while being classified as a high-pressure type when it forms discharge pressure.

Scroll compressors include a fixed scroll having a fixed wrap and an orbiting scroll having an orbiting wrap engaged with the fixed wrap. Those scroll compressors may be categorized into an orbiting back pressure type and a fixed back pressure type depending on how to form back pressure. The orbiting back pressure type forms a back pressure chamber on a rear surface of the orbiting scroll, while the fixed back pressure type forms a back pressure chamber on a rear surface of the fixed scroll. In the fixed back pressure type, the fixed scroll is normally defined as a non-orbiting scroll.

In the orbiting back pressure type and the fixed back pressure type, as the orbiting scroll is coupled to a rotating shaft to be rotatably supported by a main frame, an overturning moment acts on the orbiting scroll due to gas force of a compression chamber. Accordingly, it is advantageous, in terms of reducing the overturning moment, to secure a distance as short as possible between a first action point where centrifugal force (bearing reaction force) acts as the orbiting scroll is coupled to the rotating shaft and a second action point where gas force acts.

In the related art, a shaft-penetrating scroll compressor in which a rotating shaft is coupled through an orbiting scroll is disclosed. In the shaft-penetrating scroll compressor, as the rotating shaft passes through the orbiting scroll, a first action point at which the orbiting scroll is coupled to the rotating shaft is located at a position laterally overlapping a compression chamber, thereby reducing the overturning moment.

However, in the shaft-penetrating scroll compressor, as the rotating shaft passes through the orbiting scroll, the compression chamber is not formed in a center of the orbiting scroll. This may lower a compression ratio and decrease volumetric efficiency thereby. In addition, in the scroll compressor, a discharge port is not formed in a center of a compression part but formed to be eccentric from the center of the compression part, which shortens a compression cycle. As a result, the compression ratio may be lowered and a wrap thickness of a fixed wrap at a discharge side may be reduced, which may result in reducing reliability.

In some example compressors, a middle portion of a compression chamber is formed to be stepped, so that a wrap height is high at a suction side and low at a discharge side. This may increase a suction volume so as to enhance volumetric efficiency and simultaneously secure wrap rigidity at the discharge side so as to increase reliability.

However, in these compressors, a length of a rotating shaft coupling portion (boss portion) of an orbiting scroll coupled to a rotating shaft may extend long, which may cause the first action point to be spaced apart from the second action point. This may increase an overturning moment that much. In these compressors, a step surface is located at the suction side. As a result, at the moment when a step surface of the orbiting scroll is spaced apart from a step surface of the fixed scroll during an orbiting motion of the orbiting scroll, leakage between compression chambers may occur and thereby compression efficiency may be lowered.

SUMMARY

The present disclosure describes a scroll compressor capable of enhancing volumetric efficiency while reducing an overturning moment on an orbiting scroll.

The present disclosure also describes a scroll compressor capable of reducing an overturning moment on an orbiting scroll by reducing a distance between a first action point where centrifugal force acts as an orbiting scroll is coupled to a rotating shaft and a second action point where gas force of a compression chamber acts on the orbiting scroll.

The present disclosure further describes a scroll compressor capable of enhancing volumetric efficiency by forming a compression chamber on a central portion of an orbiting scroll while reducing a distance between a first action point where centrifugal force acts as the orbiting scroll is coupled to a rotating shaft and a second action point where gas force of the compression chamber acts on the orbiting scroll.

The present disclosure further describes a scroll compressor capable of increasing wrap rigidity while securing a suction volume.

The present disclosure further describes a scroll compressor capable of securing a suction volume and simultaneously increasing wrap rigidity by a configuration that a wrap height at a suction side is lower than a wrap height at a discharge side.

The present disclosure further describes a scroll compressor capable of suppressing compression efficiency from being lowered due to an occurrence of leakage between compression chambers at a step surface that is located between a suction side and a discharge side of the compression chamber.

In order to achieve those aspects of the present disclosure, a scroll compressor may include a main frame, a rotating shaft, an orbiting scroll, and a fixed scroll. The main frame may be fixed to an inside of the casing. The rotating shaft may be supported by being inserted through the main frame, and may include an eccentric portion. The orbiting scroll may include an orbiting end plate coupled to an eccentric portion of the rotating shaft, and an orbiting wrap extending from one side surface of the orbiting end plate. The fixed scroll may include a fixed end plate provided with a discharge port, and a fixed wrap extending from the fixed end plate toward the orbiting end plate to form compression chambers together with the orbiting wrap. The orbiting scroll may include a rotating shaft coupling portion axially extending from a central portion of the orbiting end plate to radially overlap the orbiting wrap, such that the eccentric portion of the rotating shaft is coupled thereto. A portion of the orbital wrap may extend from an end surface of the rotating shaft coupling portion facing the fixed end plate. With the configuration, a distance between bearing reaction force and gas reaction force acting on the orbiting scroll can be reduced and thus an overturning moment for the orbiting wrap can be reduced. This can stabilize a behavior of the orbiting scroll to suppress leakage between the compression chambers and reduce back pressure to decrease friction loss between the scrolls. Simultaneously, the compression chambers can be formed even in a central portion of the orbiting scroll, which can increase a compression ratio and improve volumetric efficiency.

In one example, the rotating shaft coupling portion may include a first coupling portion and a second coupling portion. The first coupling portion may extend by a preset height from one side surface of the orbiting end plate toward the fixed scroll. The second coupling portion may be connected to the first coupling portion and may extend by a preset height from another side surface of the orbiting end plate toward the main frame. The height of the first coupling portion may be lower than a wrap height of the orbiting wrap located outside the rotating shaft coupling portion. This can lower a wrap height of the orbiting wrap at a discharge end side at which pressure is relatively high, thereby increasing wrap strength for the discharge end of the orbiting wrap.

Specifically, the height of the first coupling portion may be higher than or equal to the height of the second coupling portion. This can further shorten the distance between the bearing reaction force and the gas reaction force acting on the orbiting scroll, so as to further reduce the overturning moment with respect to the orbiting scroll.

In another example, an inner circumferential surface of the rotating shaft coupling portion may overlap a discharge end of the orbiting wrap when projected in the axial direction. Accordingly, the rotating shaft coupling portion can overlap the orbiting wrap in the radial direction.

Specifically, the discharge end of the orbiting wrap may be formed as an arcuate curve. An outer circumferential surface of the rotating shaft coupling portion may be formed on a virtual circle connecting an outer surface of the orbiting wrap at the discharge end. With the configuration, the rotating shaft coupling portion can radially overlap the orbiting wrap and a wide bearing area of the rotating shaft coupling portion can be secured, thereby stably supporting the orbiting scroll and forming the compression chambers in the end surface of the rotating shaft coupling portion.

In still another example, the orbiting end plate may include an orbiting step surface between an outer surface of the orbiting wrap located at an inner side and an inner surface of the orbiting wrap located at an outer side that faces the outer surface. The fixed wrap may include a fixed step surface to correspond to the orbiting step surface. The orbiting step surface and the fixed step surface may be spaced apart from each other at a discharge starting angle of at least one of the compression chambers. With the configuration, even if leakage between the compression chambers occurs due to the orbiting step surface and the fixed step surface being spaced apart from each other, the compression chambers can communicate with each other through the discharge port, which can result in substantially suppressing compression loss due to the leakage between the compression chambers.

Specifically, the orbiting step surface and the fixed step surface may be kept spaced apart from each other during a discharge stroke of a compression chamber that communicates with the orbiting end plate. Accordingly, while the orbiting step surface and the fixed step surface are spaced apart from each other, the compression chambers can continuously communicate with the discharge port, thereby more effectively suppressing the compression loss due to the leakage between the compression chambers.

Specifically, the orbiting step surface may be formed in a shape with an arcuate cross-section between the outer surface of the orbiting wrap located at the inner side at the discharge end and the inner surface of the outer orbiting wrap located at the outer side facing the outer surface. The fixed step surface may be formed in the shape with the arcuate cross-section having a curvature greater than a curvature of the orbiting step surface. With the configuration, the orbiting step surface and the fixed step surface can be in line-contact with each other, thereby reducing friction loss between the orbiting step surface and the fixed step surface.

Also, a wrap height of the orbiting wrap located closer to a discharge side than the orbiting step surface may be lower than a wrap height of the orbiting wrap located closer to a suction side than the orbiting step surface. With the configuration, the wrap height of the orbiting wrap at a discharge side can be formed as low as possible, thereby increasing wrap strength.

A wrap thickness of the orbiting wrap located closer to a discharge side than the orbiting step surface may be thicker than a wrap thickness of a suction end of the orbiting wrap. With the configuration, the wrap thickness of the orbiting wrap at a discharge side can be formed as thick as possible, thereby increasing wrap strength.

The discharge port may accommodate one end of the orbiting end plate at a discharge starting angle of the compression chambers. With the configuration, the compression chambers can quickly communicate with the discharge port at a time when the orbiting step surface is spaced apart from the fixed end surface, which may result in suppressing compression efficiency from being lowered due to the leakage between the compression chambers.

The discharge port may be spaced apart from the orbiting step surface at the discharge starting angle of the compression chambers. At least one of the orbiting end plate and the fixed end plate may include a connection groove through which the discharge port and the orbiting step surface are connected to each other. With the configuration, the position and size of the discharge port cannot be limited, and also the compression chambers can quickly communicate with the discharge port at a time when the orbiting step surface is spaced apart from the fixed end surface, which may result in suppressing compression efficiency from being lowered due to the leakage between the compression chambers.

Specifically, the connection groove may include a first connection groove and a second connection groove. The first connection groove may be recessed in the orbiting end plate facing the discharge port in the axial direction. The second connection groove may extend from the first connection groove to the orbiting step surface. The second connection groove may have a cross-section that is smaller than that of the first connection groove. With the configuration, even when the discharge port is located far from the orbiting step surface or is made small, the discharge port and the compression chambers can communicate with each other and simultaneously a generation of a dead volume due to the connection groove can be reduced.

Specifically, the connection groove may be formed in the fixed end plate to extend from the discharge port toward an inner surface of the fixed wrap. With the configuration, even when the discharge port is located far from the fixed step surface or is made small, the discharge port and the compression chambers can communicate with each other and simultaneously a generation of a dead volume due to the connection groove can be reduced.

In order to achieve those aspects of the present disclosure, a scroll compressor may include a main frame, a rotating shaft, an orbiting scroll, and a fixed scroll. The main frame may be fixed to an inside of the casing. The rotating shaft may be supported by being inserted through the main frame, and may include an eccentric portion. The orbiting scroll may include an orbiting end plate coupled to an eccentric portion of the rotating shaft, and an orbiting wrap extending from one side surface of the orbiting end plate. The fixed scroll may include a fixed end plate provided with a discharge port, and a fixed wrap extending from the fixed end plate toward the orbiting end plate to form compression chambers together with the orbiting wrap. The orbiting end plate may include an orbiting step surface between an outer surface of the orbiting wrap located at an inner side and an inner surface of the orbiting wrap located at an outer side that faces the outer surface. The fixed wrap may include a fixed step surface to correspond to the orbiting step surface. The orbiting step surface and the fixed step surface may be spaced apart from each other during a discharge stroke of at least one of the compression chambers. With the configuration, even if leakage between the compression chambers occurs due to the orbiting step surface and the fixed step surface being spaced apart from each other, the compression chambers can communicate with the discharge port, which can result in substantially suppressing compression loss due to the leakage between the compression chambers.

In one example, the orbiting scroll may include a rotating shaft coupling portion to which the eccentric portion of the rotation shaft is coupled. The rotating shaft coupling portion may extend to an opposite side of the orbiting wrap on the basis of the orbiting end plate. With the configuration, a discharge-side volume of the compression chamber can be secured to suppress a drastic decrease of a compressor slope, thereby reducing a load applied to the fixed wrap or the orbiting wrap. At the same time, the rotating shaft coupling portion may not overlap the orbiting wrap in the radial direction, so that the orbiting step surface can be formed deeper toward the discharge end of the orbiting wrap. This can allow the discharge port and the orbiting step surface to more easily communicate with each other or the discharge port to be formed small, thereby enhancing volumetric efficiency.

In another example, each of the fixed wrap and the orbiting wrap may be configured such that a plurality of arcuate curves are continuously connected from a suction end to a discharge end. Accordingly, the wrap curves of the fixed wrap and the orbiting wrap can be formed widely, thereby increasing a stroke volume with respect to the same wrap height and end plate width.

DETAILED DESCRIPTION

Description will now be given in detail of a scroll compressor according to exemplary embodiments disclosed herein, with reference to the accompanying drawings.

A scroll compressor may be classified as a hermetic type or an open type depending on whether a drive motor and a compression part are all installed in an inner space of a casing. This embodiment will be described mainly based on the hermetic scroll compressor. However, the present disclosure may also be equally applied to the open type scroll compressor.

Scroll compressors may also be classified into a fixed scroll compressor and a movable scroll compressor. The fixed type is usually applied for air conditioning in a building, and the movable type is applied for air conditioning in a vehicle. This embodiment will be described mainly based on the fixed type scroll compressor. However, the present disclosure may also be equally applied to the movable type scroll compressor.

In addition, scroll compressors may be classified into a low-pressure type and a high-pressure type depending on pressure of refrigerant filled in an inner space of a casing. In the low-pressure type, the inner space of the casing is filled with refrigerant of suction pressure. In contrary, in the high-pressure type, the inner space of the casing is filled with refrigerant of discharge pressure. This embodiment will be described mainly based on the high-pressure type scroll compressor. However, the present disclosure may also be equally applied to the low-pressure type scroll compressor.

In addition, scroll compressors may be classified into a top-compression type and a bottom-compression type depending on an installation position of a compression part. The top-compression type includes a compression part disposed above a drive motor while the bottom-compression type includes a compression part disposed below a drive motor. This embodiment will be described mainly based on the top-compression type scroll compressor. However, the present disclosure may also be equally applied to the bottom-compression type scroll compressor.

Scroll compressors may also be classified into a one-sided rotation scroll compressor and an inter-rotation scroll compressor depending on whether scrolls rotate. The one-sided rotation scroll compressor is configured such that one scroll is fixed or restricted from rotating and the other scroll pivots, while the inter-rotation scroll compressor is configured such that both scrolls rotate. This embodiment will be described mainly based on the one-sided rotation scroll compressor. However, the present disclosure may also be equally applied to the inter-rotation scroll compressor.

Figure 1:
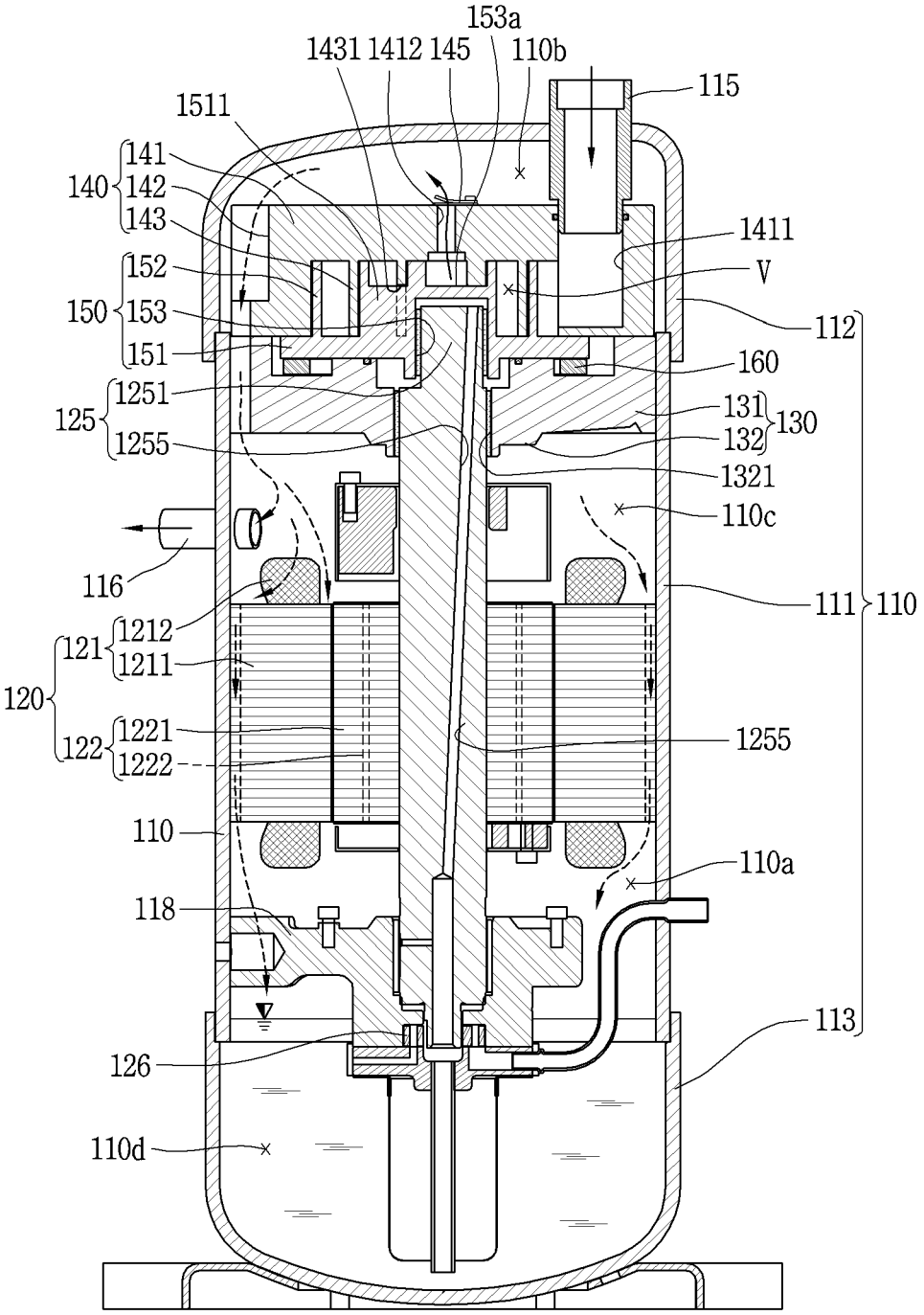
FIG. 1 is a cross-sectional view of a scroll compressor in accordance with an embodiment.
Figure 2:
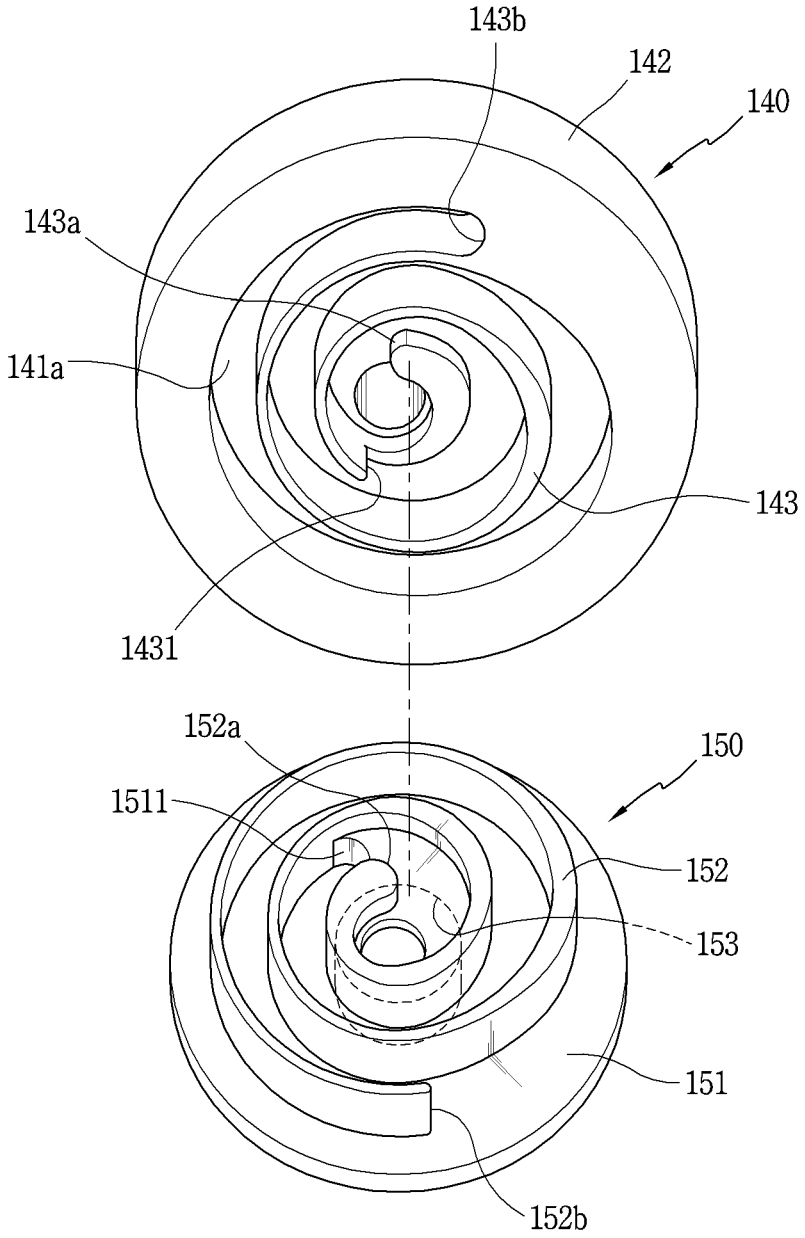
FIG. 2 is an exploded perspective view of a fixed scroll and an orbiting scroll in FIG. 1.
Figure 3:
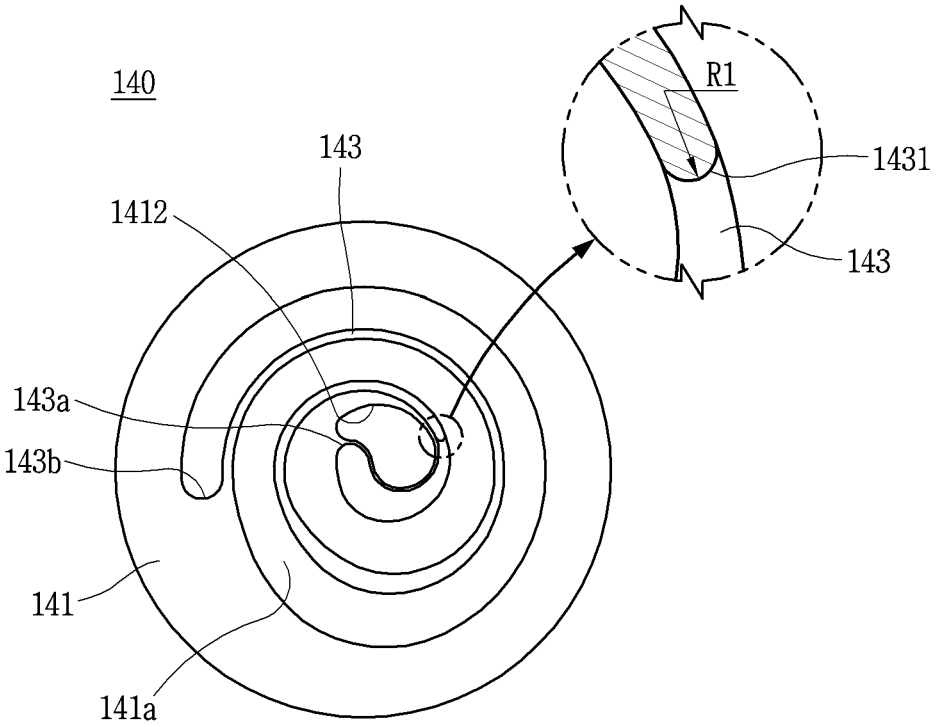
FIG. 3 is a planar view of the fixed scroll in FIG. 2.
Figure 4:
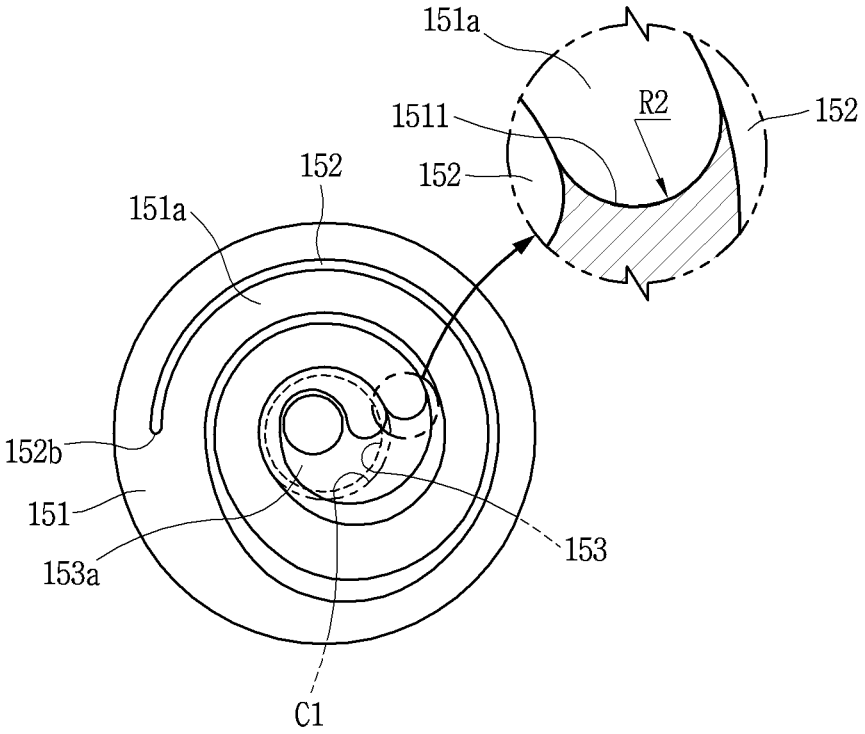
FIG. 4 is a planar view of the orbiting scroll in FIG. 2.
Figure 5:
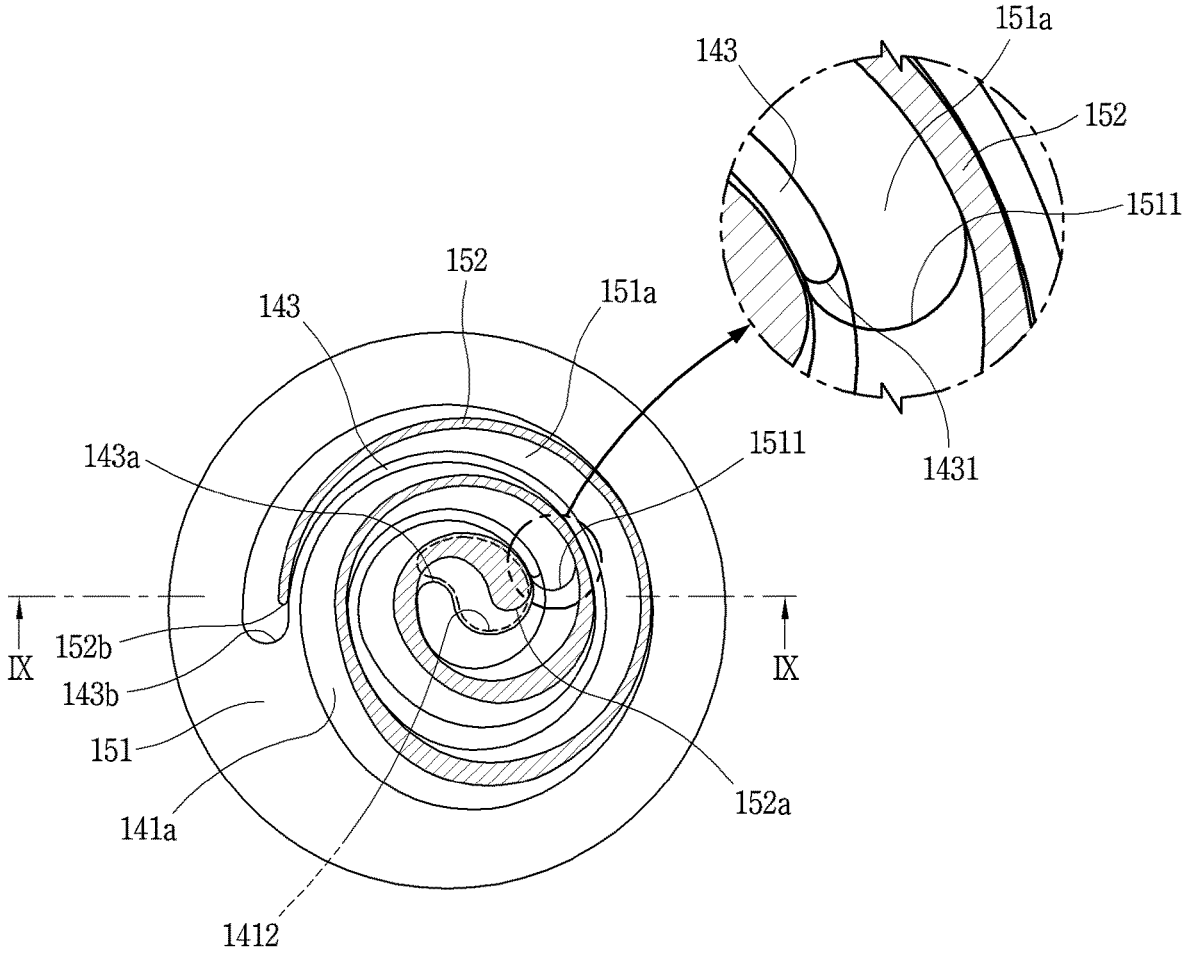
FIG. 5 is an assembled planar view of the fixed scroll and the orbiting scroll in FIG. 2.
Figure 6:
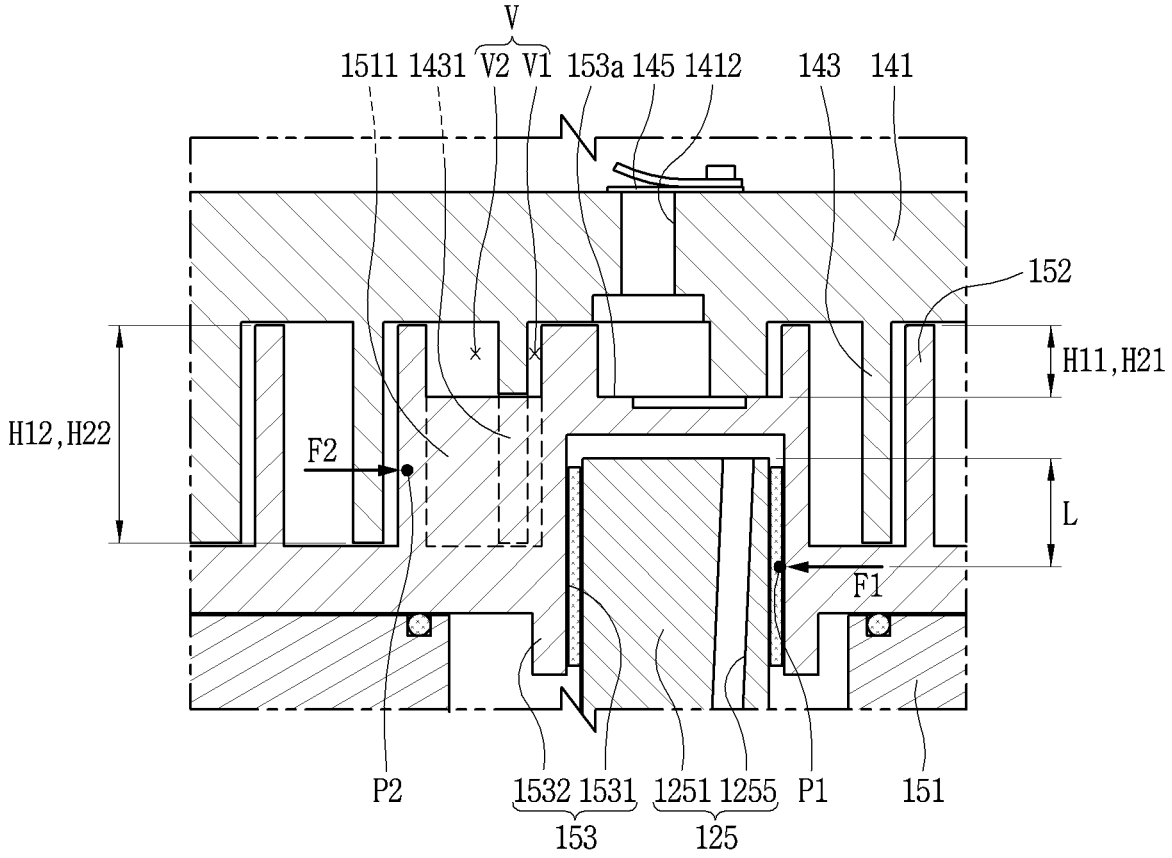
FIG. 6 is a sectional view taken along the line "IX-IX" of FIG. 5.

FIG. 1 is a cross-sectional view of a scroll compressor in accordance with an embodiment, FIG. 2 is an exploded perspective view of a fixed scroll and an orbiting scroll in FIG. 1, FIG. 3 is a planar view of the fixed scroll in FIG. 2, FIG. 4 is a planar view of the orbiting scroll in FIG. 2, FIG. 5 is an assembled planar view of the fixed scroll and the orbiting scroll in FIG. 2, and FIG. 6 is a sectional view taken along the line "IX-IX" of FIG. 5.

Referring to FIG. 1, a scroll compressor according to an embodiment of the present disclosure includes a drive motor 120 disposed in a lower half portion of a casing 110, and a main frame 130 disposed above the drive motor 120. A compression part is installed on an upper side of the main frame 130. The compression part includes a fixed scroll 140 and an orbiting scroll 150, and in some cases, the main frame 130 may also be described as being included in the compression part.

The casing 110 includes a cylindrical shell 111, an upper cap 112, and a lower cap 113. Accordingly, an inner space 110*a* of the casing 110 may be divided into an upper space 110*b* defined inside the upper cap 112, an intermediate space 110*c* defined inside the cylindrical shell 111, and a lower space 110*d* defined inside the lower cap 113, based on an order that refrigerant flows. Hereinafter, the upper space 110*b* may be defined as a discharge space, the intermediate space 110*c* may be defined as an oil separation space, and the lower space 110*d* may be defined as an oil storage space, respectively.

The cylindrical shell 111 has a cylindrical shape with upper and lower ends open, and the drive motor 120 and the main frame 130 are press-fitted to an inner circumferential surface of the cylindrical shell 111 in a lower half portion and an upper half portion, respectively.

A refrigerant discharge pipe 116 is inserted through the intermediate space 110*c* of the cylindrical shell 111, in detail, coupled through a gap between the drive motor 120 and the main frame 130. The refrigerant discharge pipe 116 may be directly inserted into the cylindrical shell 111 to be welded thereon. Alternatively, an intermediate connecting pipe (i.e., collar pipe) 117 typically made of the same material as the cylindrical shell 111 may be inserted into the cylindrical shell 111 to be welded thereon, and then the refrigerant discharge pipe 116 made of copper may be inserted into the intermediate connection pipe 117 to be welded thereon.

The upper cap 112 is coupled to cover the upper opening of the cylindrical shell 111. A refrigerant suction pipe 115 is coupled through the upper cap 112. The refrigerant suction pipe 115 is inserted through the upper space 110*b* of the casing 110 to be directly connected to a suction chamber (no reference numeral given) of the compression part to be described later. Accordingly, refrigerant can be supplied to the suction chamber through the refrigerant suction pipe 115.

The lower cap 113 is coupled to cover the lower opening of the cylindrical shell 111. The lower space 110*d* of the lower cap 113 defines an oil storage space in which a preset amount of oil is stored. The lower space 110*d* defining the oil storage space communicates with the upper space 110*b* and the intermediate space 110*c* of the casing 110 through an oil return passage (no reference numeral given). Accordingly, oil separated from refrigerant in the upper space 110*b* and the intermediate space 110*c* and oil returned after being supplied to the compression part can all be returned into the lower space 110*d* defining the oil storage space through an oil return passage to be stored therein.

Referring to FIG. 1, the drive motor 120 according to this embodiment is disposed in a lower half part of the intermediate space 110*c* defining a high-pressure part at the inner space 110*a* of the casing 110, and includes a stator 121 and a rotor 122. The stator 121 is shrink-fitted to an inner wall surface of the casing 110, and the rotor 122 is rotatably provided inside the stator 121.

The stator 121 includes a stator core 1211 and a stator coil 1212.

The stator core 1211 is formed in a cylindrical shape and is shrink-fitted onto the inner circumferential surface of the cylindrical shell 111. The stator coil 1212 is wound around the stator core 1211 and electrically connected to an external power source through a terminal (not illustrated) that is coupled through the casing 110.

The rotor 122 includes a rotor core 1221 and permanent magnets 1222.

The rotor core 1221 is formed in a cylindrical shape, and is rotatably inserted into the stator core 1211 with a preset gap therebetween. The permanent magnets 1222 are embedded in the rotor core 1221 at preset distances along the circumferential direction.

The rotating shaft 125 is press-fitted to the rotor 122. An upper end portion of the rotating shaft 125 is rotatably inserted into the main frame 130 to be described later so as to be supported in a radial direction, and a lower end portion of the rotating shaft 125 may be rotatably inserted into a sub frame 118 to be supported in the radial and axial directions.

In addition, an oil supply hole 1255 is formed inside the rotating shaft 125 to penetrate through between both ends of the rotating shaft 125. The oil supply hole 1255 penetrates from a lower end of the rotating shaft 125 to a bottom surface of an eccentric portion 1251. Accordingly, oil stored in the lower space 110*d* defining the oil storage space can be supplied into the eccentric portion 1251 through the oil supply hole 1255.

An oil pickup 126 may be installed at the lower end of the rotating shaft 125, precisely, at a lower end of the oil supply hole 1255. The oil pickup 126 may be disposed to be submerged in the oil stored in the oil storage space 110*d*. Accordingly, the oil stored in the oil storage space 110*d* can be pumped by the oil pickup 126 to be suctioned upward through the oil supply hole 1255.

The eccentric portion 1251 is disposed on an upper end of the rotating shaft 125, and coupled to a rotating shaft coupling portion 153 of an orbiting scroll 150, which will be described later. The eccentric portion 1251 may be inserted into the rotating shaft coupling portion 153 or the rotating shaft coupling portion 153 may be inserted into the eccentric portion 1251. In this embodiment, an example in which the eccentric portion 1251 of the rotating shaft 125 is inserted into an orbiting end plate 151 of the orbiting scroll 150 will be mainly described.

Referring to FIG. 1, the main frame 130 is disposed above the drive motor 120 and shrink-fitted to or welded on an inner wall surface of the cylindrical shell 111. Accordingly, the main frame 130 may usually be formed of cast iron.

The main frame 130 may include a main flange portion 131 and a shaft support protrusion 132.

The main flange portion 131 is formed in an annular shape and accommodated in the intermediate space 110*c* of the cylindrical shell 111. For example, an outer circumferential surface of the main flange portion 131 may be formed in a circular shape to be in close contact with the inner circumferential surface of the cylindrical shell 111. In this case, at least one oil return hole (not illustrated) may axially penetrate through between outer and inner circumferential surfaces of the main flange portion 131.

The shaft support protrusion 132 extends from the center of the main flange portion 131 toward the drive motor 120 and a shaft support hole 1321 is formed inside the shaft support protrusion 132. The shaft support hole 1321 may be formed through both axial side surfaces of the main flange portion 131. Accordingly, the main flange portion 131 may have an annular shape.

Referring to FIGS. 1 to 6, the fixed scroll 140 according to the embodiment includes a fixed end plate 141, a fixed side wall portion 142, and a fixed wrap 143.

The fixed end plate 141 is formed in a disk shape. An outer circumferential surface of the fixed end plate 141 may be in close contact with an inner circumferential surface of the upper cap 112 defining the upper space 110*b* or may be spaced apart from the inner circumferential surface of the upper cap 112. The fixed end plate 141 may have the same (uniform) thickness. Accordingly, a root end of the fixed wrap 143 to be described later may be formed at the same height throughout the fixing wrap 143.

A suction port 1411 is formed through an edge (rim) of the fixed end plate 141 in the axial direction to communicate with a suction chamber (no reference numeral given). The refrigerant suction pipe 115 is inserted into the suction port 1411 through the upper cap 112 of the casing 110. Accordingly, the refrigerant suction pipe 115 can directly communicate with the suction port 1411 of the fixed scroll 140 through the upper space 110*b* of the casing 110.

A discharge port 1412 and a bypass hole (not illustrated) may be formed through a center of the fixed end plate 141. A discharge valve 145 for opening and closing the discharge port 1412 and a bypass valve (not illustrated) for opening and closing the bypass hole may be disposed on an upper surface of the fixed end plate 141. Accordingly, refrigerants compressed in a first compression chamber V1 and a second compression chamber V2 are discharged from an upper side of the fixed scroll 140 into the upper space 110*b* defined in the upper cap 112. Hereinafter, a description will be given under assumption that a compression chamber formed between an outer surface of the orbiting wrap 152 and an inner surface of the fixed wrap 143 facing the same is defined as a first compression chamber V1 and a compression chamber formed between an inner surface of the orbiting wrap 152 and an outer surface of the fixed wrap 143 facing the same is defined as a second compression chamber V2.

Referring to FIGS. 3 and 5, the discharge port 1412 may be formed in various ways according to a specification of a compressor. For example, the discharge port (to be precise, a discharge inlet) 1412 may be formed in a circular shape or in a shape such as an irregular oval. This embodiment illustrates an example in which the discharge port 1412 is formed in an irregular oval shape extending long toward a discharge end of the fixed wrap 143. In this case, the discharge port 1412 may be formed along the inner surface of the fixed wrap 143 at a position where the discharge port 1412 is substantially in contact with the inner surface of the fixed wrap 143. Accordingly, the first compression chamber V1 and the second compression chamber V2 can communicate with the discharge port 1412 almost at the same time, thereby reducing overcompression loss due to a discharge delay. This may also be applicable to a case where the discharge port 1412 is formed in a circular shape.

The fixed side wall portion 142 may extend in an annular shape from an edge of the fixed end plate 141 toward the main frame 130. Accordingly, a lower surface of the fixed side wall portion 142 may be coupled by bolts in close contact with an upper surface of the main frame 130, that is, an upper surface of the main flange portion 131.

Referring to FIGS. 2 and 5, the fixed wrap 143 extends from the lower surface of the fixed end plate 141 toward the orbiting scroll 150. The fixed wrap 143 may be formed in various shapes, such as an involute shape. For example, the fixed wrap 143 may be a logarithmic spiral wrap or may be configured by a plurality of arcuate curves.

However, when the fixed wrap 143 is formed as the logarithmic spiral, the orbiting wrap 152, which will be described later, must also be formed as the logarithmic spiral. This may limit a shape of a rotating shaft coupling portion 153 to be described later and also reduce a stroke volume with respect to the same wrap height and end plate width.

Accordingly, the fixed wrap 143 according to the embodiment may have a wrap curve that is formed by connecting a plurality of arcs having different diameters and origins. Accordingly, the fixed wrap 143 may have different wrap thicknesses along a wrap formation direction.

For example, the fixed wrap 143 according to the embodiment may be formed so that a wrap thickness of a discharge end 143*a* that is a center side is thicker than a wrap thickness of a suction end 143*b* that is an outermost side. This can increase wrap strength at the discharge end 143*a* of the fixed wrap 143 that receives relatively high gas force, thereby suppressing damage on the fixed wrap 143. In addition, the wrap curve of the fixed wrap 143 can be formed widely, thereby increasing a stroke volume with respect to the same wrap height and end plate width. These advantages can also be expected in the orbiting wrap 152 to be described later.

Referring to FIGS. 5 and 6, the fixed wrap 143 may have the same wrap height or different heights in the wrap formation direction. In this embodiment, an example in which the wrap height of the fixed wrap 143 differs along the wrap formation direction of the fixed wrap 143 is illustrated. For example, in this embodiment, a fixed step surface 1431 to be described later is formed at the middle of the fixed wrap 143. A wrap height H11 of the discharge end 143*a* that is located at a center side with respect to the fixed step surface 1431 is lower than a wrap height H12 of the suction end 143*b* that is located at the outermost side. This can increase wrap strength at the discharge end 143*a* of the fixed wrap 143 that receives relatively high gas force, thereby suppressing damage on the fixed wrap 143.

The fixed step surface 1431 may be formed at a position where a compression chamber (e.g., the first compression chamber V1), in which discharging is started relatively early of the both compression chambers V1 and V2, communicates with the discharge port 1412 at its discharge starting angle (discharge starting time point). This is also applied equally to an orbiting step surface 1511 to be explained later, which will be described again later.

The fixed step surface 1431 is formed as a curved surface having a preset curvature. For example, the fixed step surface 1431 may be formed in an arcuate shape protruding toward an orbiting step surface 1511 to be described later, and have a curvature R1 that is greater than a curvature R2 of the orbiting step surface 1511. Accordingly, the fixed step surface 1431 can be in line-contact with the orbiting step surface 1511, thereby minimizing friction loss.

A step height of the fixed step surface 1431 may be substantially the same as a step height of the orbiting step surface 1511 to be explained later. Accordingly, even if the fixed step surface 1431 is formed on the fixed wrap 143, an end surface of the fixed wrap 143 and a compression surface 151*a* of the orbiting end plate 151 can be in close contact with each other so as to seal between the both compression chambers.

Referring to FIGS. 1 to 6, the orbiting scroll 150 according to the embodiment may include an orbiting end plate 151, an orbiting wrap 152, and a rotating shaft coupling portion 153.

The orbiting end plate 151 is formed in a disk shape and is supported in the axial direction by the main frame 130 so as to perform an orbiting motion between the main frame 130 and the fixed scroll 140.

The orbiting end plate 151 may have the same thickness or may partially have different thicknesses. For example, when the rotating shaft coupling portion 153 extends only toward the main frame from a rear surface of the orbiting end plate 151, the orbiting end plate 151 may have the same thickness as a whole. On the other hand, when the rotating shaft coupling portion 153 is inserted through the orbiting end plate 141 to radially overlap the orbiting wrap 152 to be explained later, the thickness of the orbiting end plate 151 may increase partially, in other words, increase at a portion where the rotating shaft coupling portion 153 is formed.

Referring to FIGS. 4 to 6, the embodiment illustrates an example in which the thickness of the orbiting end plate 151 at the center side is thicker than the thickness thereof at the edge side. In other words, the orbiting end plate 151 according to the embodiment has the orbiting step surface 1511 formed at an arbitrary point in the compression chamber V. Accordingly, the upper surface (compression surface) 151*a* of the orbiting end plate 151 is formed such that a height of the orbiting end plate 151 of a suction side on the basis of the orbiting step surface 1511 is higher than a height of the orbiting end plate 151 of a discharge side. Therefore, the rotating shaft coupling portion 153 to be described later can protrude and extend in a direction toward the fixed end plate 141.

The orbiting step surface 1511 connects between the outer surface of the orbiting wrap 152 at the discharge end 152*a* and the inner surface of the orbiting wrap 152 facing the same in the radial direction. Here, the orbiting step surface 1511, similar to the fixed step surface 1431, may be formed at a position where a compression chamber (e.g., first compression chamber V1) that is adjacent to the discharge port 1412 of the both compression chambers communicates with the discharge port 1412 at its discharge starting angle (discharge starting time point) A1.

In other words, as the discharge port 1412 is formed long in the irregular oval shape, one end of the orbiting step surface 1511 (precisely, an outer surface side of the orbiting wrap) may communicate with or axially overlap a portion of the discharge port 1412 when the orbiting step surface 1511 and the fixed step surface 1431 are spaced apart from each other. Accordingly, the compression chambers V1 and V2 communicate with each other at the moment when the orbiting step surface 1511 is spaced apart from the fixed step surface 1431 during the orbiting motion of the orbiting scroll 150. At the same time, one compression chamber (for example, the first compression chamber V1) communicates with the discharge port 1412. Then, even if the compression chambers V1 and V2 communicate with each other, refrigerants in the both compression chambers V1 and V2 can all move to the discharge port 1412 to be discharged together, resulting in suppressing compression loss in the both compression chambers V1 and V2.

The orbiting step surface 1511 is formed as a curved surface having a preset curvature R2. For example, the fixed step surface 1511 may be formed in an arcuate shape recessed with respect to the fixed step surface 1431, to have a curvature R2 that is smaller than the curvature R1 of the fixed step surface 1431. Accordingly, the fixed step surface 1511 can be in line-contact with the orbiting step surface 1431, thereby minimizing friction loss.

A step height of the orbiting step surface 1511 may be substantially the same as a step height of the fixed step surface 1431. Accordingly, as described above, even when the orbiting step surface 1511 is formed on the orbiting end plate 151, the compression surface 151*a* of the orbiting end plate 151 and the end surface of the fixed wrap 143 can be in close contact with each other, thereby sealing between the both compression chambers.

Referring to FIGS. 5 and 6, the orbiting step surface 1511, similar to the fixed step surface 1431 as described above, may be formed at a position at the discharge starting angle A1 of the compression chamber (e.g., the first compression chamber V1) in which discharging is started relatively early of the both compression chambers V1 and V2. This will be described again later.

Referring to FIGS. 4 to 6, the orbiting wrap 152 extends from the upper surface (compression surface) of the orbiting end plate 151 toward the fixed scroll 140. The orbiting wrap 152 may then be engaged with the fixed wrap 143 to define the pair of compression chambers V1 and V2.

The orbiting wrap 152 may be formed in various shapes, such as an involute shape, to correspond to the fixed wrap 143. For example, the orbiting wrap 152 may be a logarithmic spiral wrap or may be configured by a plurality of arcuate curves.

However, as described in relation to the fixed wrap, when the orbiting wrap 152 is formed as the logarithmic spiral, a shape of a rotating shaft coupling portion 153 to be described later may be limited and a stroke volume with respect to the same wrap height and end plate width may be reduced. Accordingly, the orbiting wrap 152 according to the embodiment, similar to the fixed wrap 143, may have a wrap curve that is formed by connecting a plurality of arcs having different diameters and origins. Accordingly, the orbiting wrap 152 may have different wrap thicknesses along the wrap formation direction, similar to the fixed wrap 143.

For example, the orbiting wrap 152 according to the embodiment may be formed so that a wrap thickness of a discharge end 152*a* that is a center side is thicker than a wrap thickness of a suction end 152*b* that is an outermost side. This can increase wrap strength at the discharge end 152*a* of the orbiting wrap 152 that receives relatively high gas force, thereby suppressing damage on the orbiting wrap 152. In addition, the wrap curve of the fixed wrap 143 can be formed widely, thereby increasing a stroke volume with respect to the same wrap height and end plate width.

The orbiting wrap 152 may have the same wrap height or different heights in the wrap formation direction. In this embodiment, an example in which the wrap height of the orbiting wrap 152 differs along the wrap formation direction is illustrated. For example, in this embodiment, the orbiting wrap 152 is formed such that a wrap height H21 of the discharge end 152*a* that is located at the center side with respect to the orbiting step surface 1431 is lower than a wrap height H22 of the suction end 152*b* that is located at the outermost side. This can increase wrap strength at the discharge end 152*a* of the orbiting wrap 152 that receives relatively high gas force, thereby suppressing damage on the orbiting wrap 152.

Referring to FIGS. 4 and 6, the rotating shaft coupling portion 153 is a portion to which the eccentric portion 1251 of the rotating shaft 125 is coupled. The rotating shaft coupling portion 153 has a cylindrical shape and an eccentric bearing configured as a bush bearing is disposed on an inner circumferential surface of the rotating shaft coupling portion 153. Hereinafter, for the sake of explanation, the bush bearing is defined as the inner circumferential surface of the rotating shaft coupling portion 153. Accordingly, the inner circumferential surface of the rotating shaft coupling portion 153 may be understood as substantially referring to an inner circumferential surface of the bush bearing.

The rotating shaft coupling portion 153 is formed to be located at an inner side of the orbiting wrap 152. For example, the inner circumferential surface of the rotating shaft coupling portion 153 is formed at a position overlapping the discharge end of the orbiting wrap 152 when projected in the axial direction. In other words, an outer circumferential surface of the rotating shaft coupling portion 153 is formed to be located on the same circle as a virtual circle C1 connecting the outer surface of the orbiting wrap 152 at the discharge end 152*a*. Accordingly, the inner surface of the orbiting wrap 152 in the vicinity of the discharge end 152*a* is located more inward than the outer circumferential surface of the rotating shaft coupling portion 153 as described above, that is, the end surface 153*a* of the rotating shaft coupling portion 153. Then, the rotating shaft coupling portion 153 can be formed to overlap the orbiting wrap 152 in the radial direction while a wide bearing area of the rotating shaft coupling portion 153 can secured, thereby stably supporting the orbiting scroll 150 and simultaneously forming the compression chambers V1 and V2 on the end surface 153*a* of the rotating shaft coupling portion 153.

The rotating shaft coupling portion 153 includes a first coupling portion 1531 extending from the compression surface of the orbiting end plate 151 and a second coupling portion 1532 extending from a rear surface of the orbiting end plate 151. In some cases, the rotating shaft coupling portion 153 may merely include the first coupling portion 1531, but this embodiment illustrates an example in which the rotating shaft coupling portion 153 includes the first coupling portion 1531 and the second coupling portion 1532.

The first coupling portion 1531 extends from the compression surface 151*a* of the orbiting end plate 151 toward the fixed scroll 140 by a preset height. The first coupling portion 1531 is formed in a structure in which a lower end into which the rotating shaft 125 is inserted is open while an upper end is closed. Accordingly, it may be understood that the first coupling portion 1531 is recessed with respect to the rear surface 151*b* of the orbiting end plate 151 while protruding with respect to the compression space. However, hereinafter, in consideration of comparison with the second coupling portion 1532 to be described later, a description will be given under assumption that the first coupling portion 1531 protrudes.

As described above, the first coupling portion 1531 is formed to have the upper end closed, for example, have a shape with a cross-section like a cap. Accordingly, an insertion depth of the eccentric portion 1251 of the rotating shaft 125 is limited by the upper end (precisely, the inner surface of the upper end) of the first coupling portion 1531.

An axial height H31 of the first coupling portion 1531 (hereinafter, a height of the first coupling portion) is lower than the wrap height of the orbiting wrap 152, i.e., the wrap height H22 of the orbiting wrap 152 at the suction end 152*b* that is located outside the rotating shaft coupling portion 153. For example, the height H31 of the first coupling portion 1531 may be approximately half the wrap height H22 of the orbiting wrap 152 at the suction end 152*b*. This can reduce a distance L (a length of a moment arm) between a first action point P1 at which the rotating shaft 125 is coupled to the orbiting scroll 150 and a second action point P2 at which gas force of the compression chamber V acts on the orbiting wrap 152, while the relevant compression chamber V can be formed on the end surface 153*a* of the rotating shaft coupling portion 153.

In addition, the height H31 of the first coupling portion 1531 can be higher than or equal to an axial height H32 of the second coupling portion 1532 to be explained later. Accordingly, a distance L (length of the moment arm) between the first action point P1 and the second action point P2 described above can be significantly reduced.

The second coupling portion 1532 extends from the rear surface 151*b* of the orbiting end plate 151 toward the drive motor 120 by a preset height. The second coupling portion 1532 is formed in an annular shape so that the rotating shaft 125 passes therethrough. A portion of the eccentric bearing described above is fitted to an inner circumferential surface of the second coupling portion 1532. Accordingly, an inner diameter of the second coupling portion 1532 is the same as an inner diameter of the first coupling portion 1531.

The axial height H32 of the second coupling portion 1532 is equal to or smaller than the height H31 of the first coupling portion 1531. Accordingly, the distance between the first action point P1 and the second action point P2 described above can be minimized.

Although not illustrated, the second coupling portion 1532 may be excluded. In other words, the rotating shaft coupling portion 153 may merely include the first coupling portion 1531. However, in this case, the height H31 of the first coupling portion 1531 may increase or the inner diameter of the first coupling portion 1531 may be enlarged while maintaining the height H31 of the first coupling portion 1531. This can secure a support area of the eccentric portion 1251, that is, a bearing area of the eccentric portion 1251.

In the drawings, a reference numeral 160 denotes an Oldham ring.

The scroll compressor according to the embodiment can obtain the following operating effects.

That is, when power is applied to the drive motor 120 and rotational force is generated, the orbiting scroll 150 eccentrically coupled to the rotating shaft 125 performs an orbiting motion relative to the fixed scroll 140 by the Oldham ring 160. At this time, a first compression chamber V1 and a second compression chamber V2 that continuously move are formed between the fixed scroll 140 and the orbiting scroll 150.

Then, the first compression chamber V1 and the second compression chamber V2 are gradually reduced in volume as moving from the suction port (or suction chamber) 1411 to the discharge port (or discharge chamber 1412) during the orbiting motion of the orbiting scroll 150.

Refrigerant is then introduced into the first compression chamber V1 and the second compression chamber V2 through the suction port 1411 of the fixed scroll 140 via the refrigerant suction pipe 115. The refrigerant is compressed while moving toward the final compression chamber by the orbiting scroll 150. The refrigerant is discharged from the final compression chamber into the inner space 110*a* of the casing 110 through the discharge port 1412 of the fixed scroll 140, and then moves to the intermediate space 110*c* and/or the lower space 110*d* of the casing 110 through an outflow passage (not illustrated) defined in the fixed scroll 140 and the main frame 130.

Oil is separated from the refrigerant while the refrigerant circulates in the inner space 110*a* of the casing 110. The oil separated from the refrigerant flows to be filled in the oil storage space defining the lower space 110*d* of the casing 110 and then is supplied to the compression part through the oil pickup 126 and the oil supply hole 1255 of the rotating shaft 125. On the other hand, the refrigerant from which the oil has been separated is discharged to the outside of the casing 110 through the refrigerant discharge pipe 116. Such processes are repeated.

On the other hand, during the operation of the compressor, the orbiting scroll 150 receives bearing reaction force F1 corresponding to centrifugal force due to being eccentrically coupled to the rotating shaft 125 and simultaneously receives gas reaction force F2 of the refrigerant compressed in the compression chamber V. At this time, if the distance L between the first action point P1 where the bearing reaction force F1 acts and the second action point P2 where the gas reaction force F2 acts is long, an overturning moment increases accordingly, which may make a behavior of the orbiting scroll 150 unstable, thereby causing leakage between the compression chambers V1 and V2.

In consideration of this, if back pressure supporting the orbiting scroll 150 is increased, the orbiting scroll 150 may be deformed by the back pressure to cause the leakage between the compression chambers V1 and V2 or the orbiting scroll 150 may be excessively brought into contact with the fixed scroll 140 to cause an increase in friction loss. This may be particularly disadvantageous in low pressure/low load operation.

However, as illustrated in this embodiment, as a portion of the rotating shaft coupling portion 153 protrudes toward the fixed scroll 140 (recessed when viewed from the rotating shaft side) to radially overlap the orbiting wrap 152, a bearing surface between the orbiting scroll 150 and the rotating shaft 125 is formed at a position where it overlaps the compression chambers V1 and V2 in the radial direction. Then, the distance L between the first action point P1 and the second action point P2 can be reduced, thereby reducing the overturning moment. Accordingly, the behavior of the orbiting scroll 150 can be stabilized, so as to suppress the leakage between the compression chambers V1 and V2, and back pressure required can be reduced, so as to suppress the deformation of the orbiting scroll 150 or the excessive contact between the scrolls.

In addition, in this embodiment, as the portion of the orbiting wrap 152 extends from the end surface 153*a* of the rotating shaft coupling portion 153, a compression chamber may be formed even in the central portion of the orbiting scroll 150 (or the fixed scroll). Accordingly, the rotating shaft coupling portion 153 can extend toward the orbiting wrap 152 and a compression cycle of the compression chamber can be increased. This can increase a compression ratio and thus improve volumetric efficiency. At the same time, the wrap height of the orbiting wrap 152 at the discharge end 152*a* is decreased and the wrap thickness thereof is increased, so that the wrap strength of the orbiting wrap 152 can increase and a wrap breakage can be suppressed. These advantages can also be expected in the fixed wrap 143.

In addition, in this embodiment, as the rotating shaft coupling portion 153 is formed to radially overlap the orbiting wrap 152, the orbiting step surface 1511 is formed on the orbiting end plate 151. As the orbiting step surface 1511 is formed, the fixed step surface 1431 corresponding to the orbiting step surface 1511 is formed on the fixed wrap 143. As a result, during the orbiting motion of the orbiting scroll 150, the orbiting step surface 1511 and the fixed step surface 1431 may be spaced apart from each other, which may cause the leakage between the compression chambers V1 and V2.

However, in this embodiment, the orbiting step surface 1511 and the fixed step surface 1431 are located at a position where a time point at which the orbiting step surface 1511 is spaced apart from the fixed step surface 1431 corresponds to the discharge starting angle (discharge starting time point) A1 where the both compression chambers V1 and V2 communicate with the discharge port 1412. Accordingly, since both compression chambers V1 and V2 communicate with the discharge port 1412 when the orbiting step surface 1511 is spaced apart from the fixed step surface 1431, the leakage between the compression chambers V1 and V2 does not occur substantially.

Figure 7:
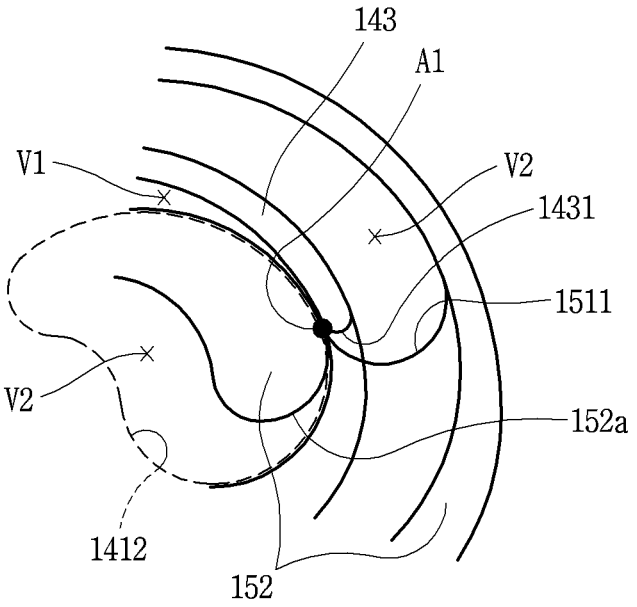
FIG. 7 is a schematic view illustrating an orbiting step surface and a fixed step surface immediately before the start of discharge.
Figure 8:
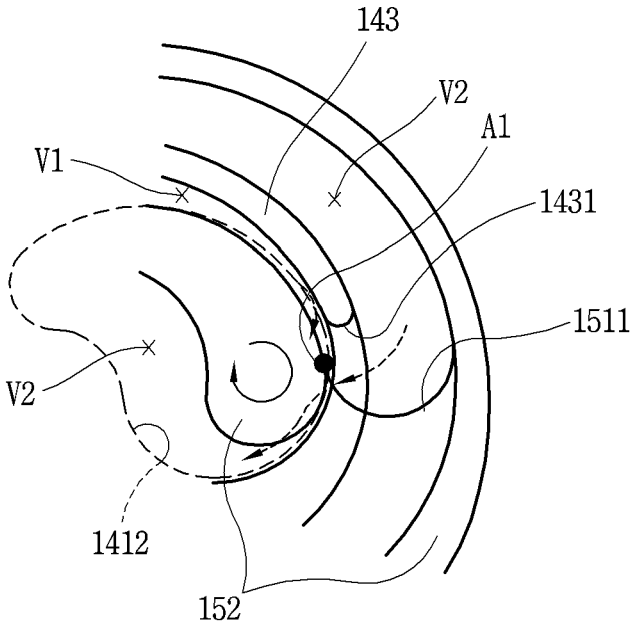
FIG. 8 is a schematic view illustrating the orbiting step surface and the fixed step surface at the moment of starting discharge.

FIG. 7 is a schematic view illustrating an orbiting step surface and a fixed step surface immediately before the start of discharge, and FIG. 8 is a schematic view illustrating the orbiting step surface and the fixed step surface at the moment of starting discharge.

Referring to FIG. 7, during the orbiting motion of the orbiting scroll 150, each of the first compression chamber V1 and the second compression chamber V2 continuously moves from a suction side to a discharge side to compress refrigerant. The refrigerant is then continuously compressed until the first and second compression chambers V1 and V2 reach the discharge port 1412 and moves toward the discharge port 1412.

At this time, before the first compression chamber V1 and the second compression chamber V2 reach the discharge port 1412, that is, while the first compression chamber V1 and the second compression chamber V2 perform a compression stroke, the orbiting step surface 1511 is kept in contact with the fixed step surface 1431. This continues until just before discharging from the first compression chamber V1 and the second compression chamber V2 is started.

Referring to FIG. 8, when the first compression chamber V1 and the second compression chamber V2 reach the discharge port 1412, the first compression chamber V1 and the second compression chamber V2 communicate with the discharge port 1412, such that the refrigerant in the first compression chamber V1 and the refrigerant in the second compression chamber V2 start to be discharged through the discharge port 1412. Depending on the shape of the discharge port 1412, both the compression chambers V1 and V2 may be open almost at the same time or may be open with a predetermined time difference.

At this time, the orbiting step surface 1511 is spaced apart from the fixed step surface 1431. In other words, at the time point when discharging is started as the first compression chamber V1 and/or the second compression chamber V2 communicates with the discharge port 1412, the orbiting step surface 1511 and the fixed step surface 1431 are spaced apart from each other. Then, the refrigerant in a compression chamber (e.g., the second compression chamber V2) of relatively high pressure may partially leak into another compression chamber (e.g., the first compression chamber V1) of relatively low pressure.

However, since the first compression chamber V1 has already reached the discharge starting angle (discharge starting time point) A1 and communicated with the discharge port 1412, the refrigerant introduced into the first compression chamber V1 from the second compression chamber V2 is discharged by moving to the discharge port 1412 together with the refrigerant in the first compression chamber V1. As described above, the state in which the orbiting step surface 1511 is spaced apart from the fixed step surface 1431 is maintained while the first compression chamber V1 and the second compression chamber V2 perform a discharge stroke.

Then, even if refrigerant of relatively high pressure flows into the first compression chamber V1 from the second compression chamber V2, the refrigerant is not over-compressed and thus motor efficiency cannot be lowered. Also, refrigerant that has reached discharge pressure in the second compression chamber V2 is discharged to the discharge port 1412 through the first compression chamber V1 and thus decrease in volumetric efficiency can be suppressed. In addition, as the refrigerant in the second compression chamber V2 is discharged in advance through the first compression chamber V1, discharge resistance can decrease, thereby suppressing overcompression in the second compression chamber V2.

Responsive to this, even if the orbiting step surface 1511 is spaced apart from the fixed step surface 1431 and thereby the compression chambers V1 and V2 communicate with each other, the refrigerants are discharged to the outside of the compression chambers through the discharge port 1412. Accordingly, even if the compression chambers V1 and V2 communicate with each other as the orbiting step surface 1511 and the fixed step surface 1431 are spaced apart from each other, decrease in compression efficiency due to the leakage between the compression chambers V1 and V2 may not occur or can be significantly suppressed.

Hereinafter, a description will be given of another embodiment of a discharge structure.

That is, the previous embodiment illustrates that the discharge port communicates with both compression chambers almost at the same time, but in some cases, the discharge port may communicate with both compression chambers with a time difference. It does not absolutely depend on the shape of the discharge port. In other words, even when the discharge port is formed in the irregular oval shape as in the previous embodiment, the discharge port may communicate with both compression chambers with a time difference. However, in this embodiment, an example in which the discharge port communicates with both compression chambers with a time difference when the discharge port is formed in a circular shape will be described.

Figure 9:
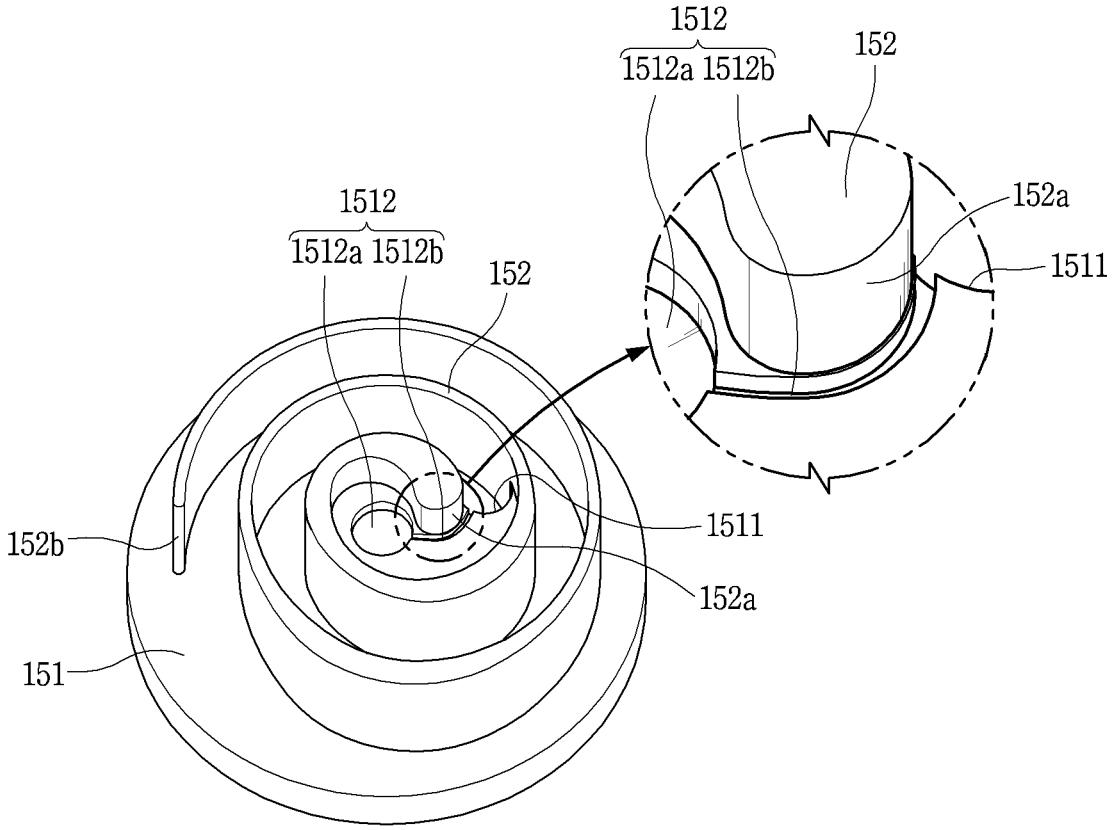
FIG. 9 is a perspective view illustrating another embodiment of an orbiting scroll.
Figure 10:
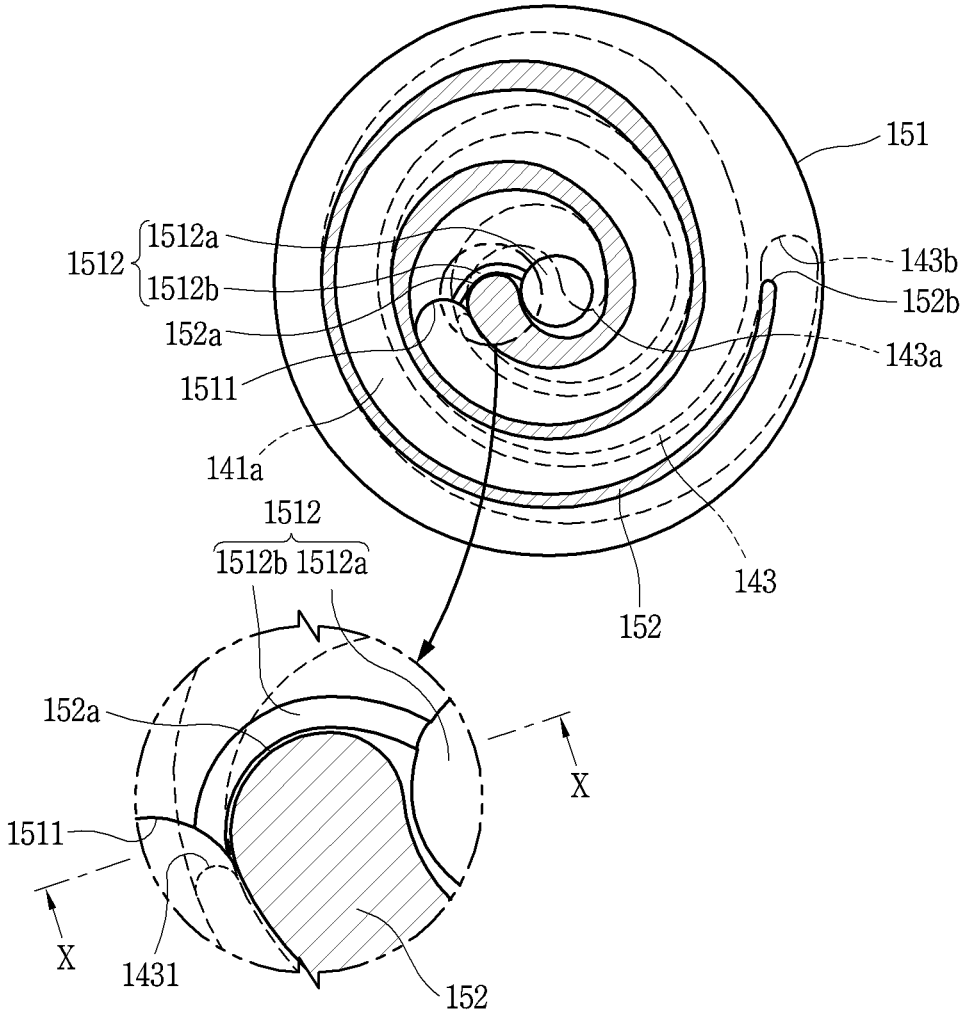
FIG. 10 is a planar view of FIG. 9.
Figure 11:
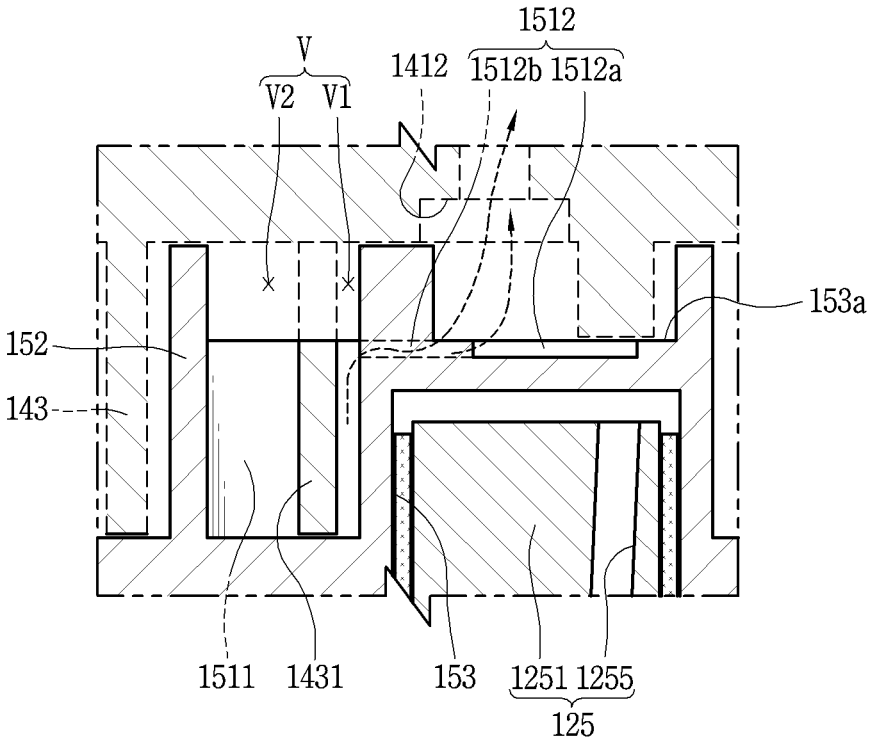
FIG. 11 is a sectional view taken along the line "X-X" of FIG. 10.

FIG. 9 is a perspective view illustrating another embodiment of an orbiting scroll, FIG. 10 is a planar view of FIG. 9, and FIG. 11 is a sectional view taken along the line "X-X" of FIG. 10.

Referring to FIGS. 9 to 11, the basic configuration of the scroll compressor according to this embodiment and operating effects thereof are similar to those in the previous embodiment. For example, the orbiting scroll 150 is provided with the rotating shaft coupling portion 153, and a portion of the rotating shaft coupling portion 153 protrudes by a preset height from the compression surface 151*a* of the orbiting end plate 151. Accordingly, a portion of the eccentric portion 1251 of the rotating shaft 125 is inserted into the rotating shaft coupling portion 153 to radially overlap the orbiting wrap 152, thereby reducing the distance between the first action point P1 and the second action point P2.

In addition, as the discharge end 152*a* of the orbital wrap 152 extends to the end surface 153*a* of the rotating shaft coupling portion 153, the rotating shaft coupling portion 153 may extend toward the orbiting wrap 152 while extending the compression cycle of the compression chambers V1 and V2. This can enhance volumetric efficiency of the compression chambers while increasing wrap strength by lowering the wrap height and thickening the wrap thickness of the orbiting wrap 152.

In addition, as the orbiting step surface 1511 is formed on the orbiting end plate 151 and the fixed step surface 1431 is formed on the fixed wrap 143, respectively, the rotating shaft coupling portion 153 may overlap the orbiting wrap 152 and the discharge end 152*a* of the orbital wrap 152 may extend to the end surface of the rotating shaft coupling portion 153. At the same time, the fixed wrap 143, similar to the orbiting wrap 152, may be formed such that the wrap height is lowered and the wrap thickness is increased at the discharge end 152*a*, thereby increasing the wrap strength.

However, in the previous embodiment, the discharge port 1412 may extend long such that a portion thereof can be connected to or overlap the orbiting step surface 1511 in the axial direction. Accordingly, the compression chambers V1 and V2 can communicate with the discharge port 1412 when the orbiting step surface 1511 and the fixed step surface 1431 are spaced apart from each other. However, in this embodiment, the discharge port 1412 may be formed at a position where it is spaced apart from the orbiting step surface 1511 at a time when the orbiting step surface 1511 is spaced apart from the fixed step surface 1431. In this case, a connection groove 1512 may be formed in the orbiting end plate 151 so that the discharge port 1412 can be connected to the orbiting step surface 1511.

Referring to FIGS. 10 and 11, the connection groove 1512 according to this embodiment includes a first connection groove 1512*a* and a second connection groove 1512*b*.

The first connection groove 1512*a* is formed in a central side of the orbiting end plate 151, such that at least a portion always communicates with the discharge port 1412 in the axial direction when projected in the axial direction. For example, the first connection groove 1512*a* may be formed in a kind of dimple shape in the central side of the orbiting end plate 151, and may axially overlap at least a portion of the discharge port 1412 when the orbiting scroll 150 performs the orbiting motion. Accordingly, the first connection groove 1512*a* can continuously communicate with the discharge port 1412 during the operation of the compressor.

Also, the first connection groove 1512*a* may be formed wider than the discharge end 143*a* of the fixed wrap 143. Accordingly, the compression chambers V1 and V2 can communicate with each other through the first connection groove 1512*a*, thereby suppressing a discharge delay.

The second connection groove 1512*b* may be formed to connect the first connection groove 1512*a* to the orbiting step surface 1511. For example, one end of the second connection groove 1512*b* may communicate with the first connection groove 1512*a*, and another end of the second connection groove 1512*b* may communicate with the orbiting step surface 1511. Accordingly, refrigerants can move from the compression chambers V1 and V2 formed near the orbiting step surface 1511 to the first connection groove 1512*a* through the second connection groove 1512*b*, so as to be guided to the discharge port 1412.

The second connection groove 1512*b* may have a cross-section that is smaller than a cross-section of the first connection groove 1512*a*. This can suppress an increase in dead volume by the second connection groove 1512*b*.

The second connection groove 1512*b* may be formed to be curved. For example, as illustrated in FIGS. 9 and 10, when the orbiting step surface 1511 is formed to connect an outer surface of the inner orbiting wrap 152 (i.e., located at an inner side) and an inner surface of the outer orbiting wrap 152 (i.e., located at an outer side), the orbiting step surface 1511 and the first connection groove 1512*a* are blocked from each other by the orbiting wrap 152. Accordingly, the second connection groove 1512*b* may connect the first connection groove 1512*a* and the orbiting step surface 1511 by surrounding the discharge end 152*a* of the orbiting wrap 152 without crossing the discharge end 152*a* of the orbiting wrap 152. Accordingly, the second connection groove 1512*b* may be formed in a curved shape to correspond to the shape of the discharge end 152*a* of the orbiting wrap 152.

When the connecting groove 1512 is formed in the orbiting end plate 151 as described above, refrigerants can quickly move to the discharge port 1412 from the compression chambers V1 and V2 near the orbiting step surface 1511 through the connection groove even if the discharge port 1412 is spaced apart from the orbiting step surface 1511 when projected in the axial direction. Accordingly, the compression chambers V1 and V2 can communicate with the discharge port 1412 at the time when the orbiting step surface 1511 is spaced apart from the fixed step surface 1431, as in the previous embodiment. The operation effects thereof have been described above, and thus a detailed description thereof will be omitted.

Although not illustrated, the second connection groove 1512*b* may be formed in a linear shape. For example, when the orbiting step surface 1511 is formed to connect the outer surface of the inner orbiting wrap and the inner surface of the outer orbiting wrap 152 in the middle between the outer surface and the inner surface of the orbiting wrap 152, the orbiting step surface 1511 and the first connection groove 1512*a* are not blocked from each other by the orbiting wrap 152. In this case, the second connection groove 1512*b* may be formed linearly to connect the first connection groove 1512*a* and the orbiting step surface 1511.

Hereinafter, a description will be given of still another embodiment of a discharge structure.

That is, the connection groove in the previous embodiment is formed in the orbiting end plate, but in some cases, the connection groove may alternatively be formed in the fixed end plate.

Figure 12:
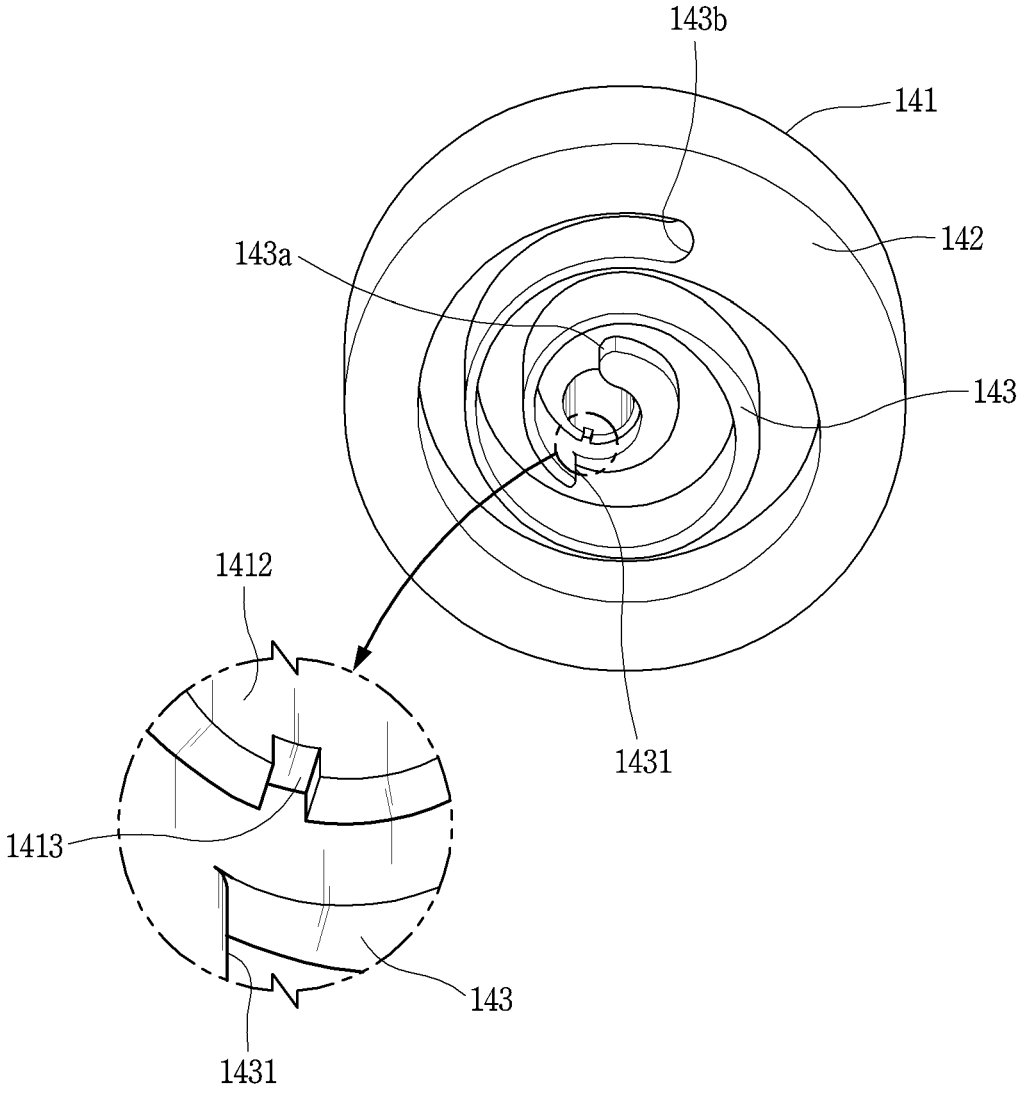
FIG. 12 is a perspective view illustrating another embodiment of a fixed scroll.
Figure 13:
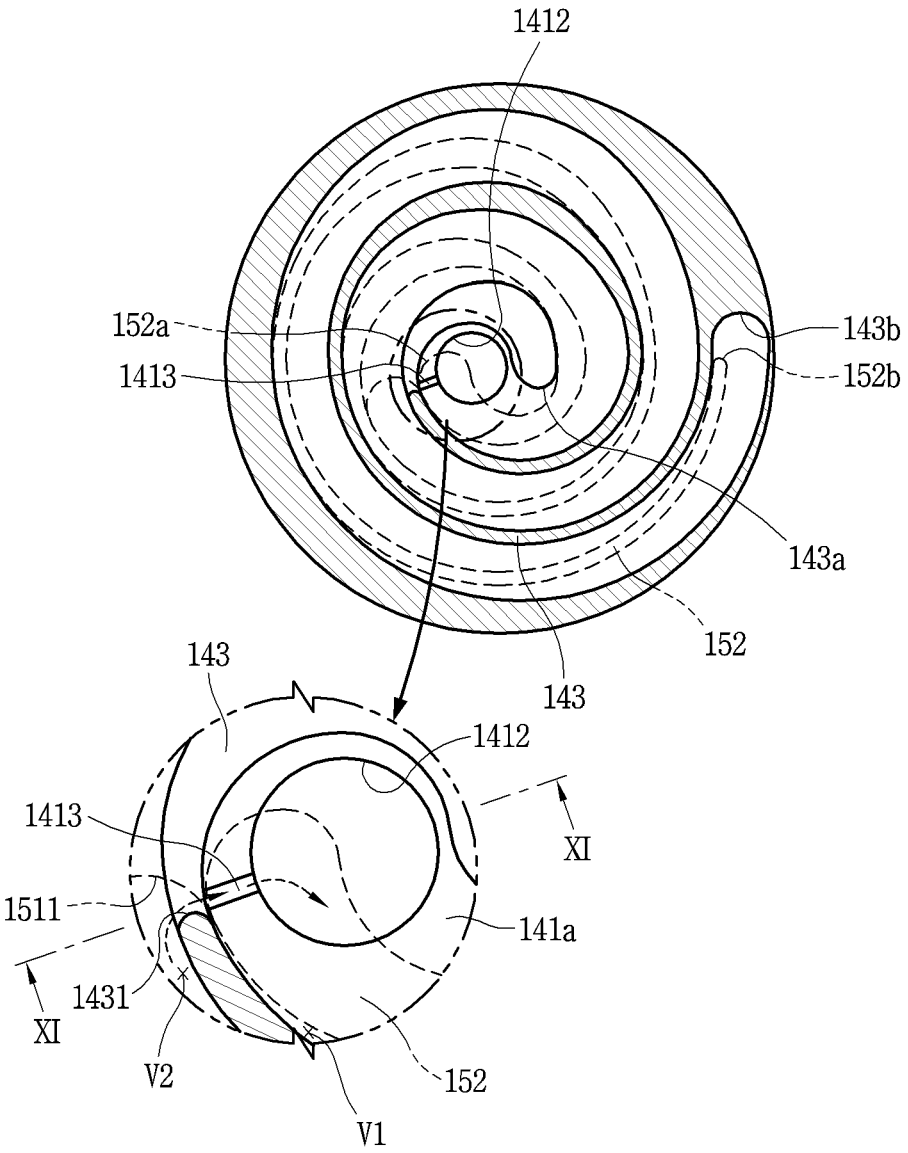
FIG. 13 is a planar view of FIG. 12.
Figure 14:
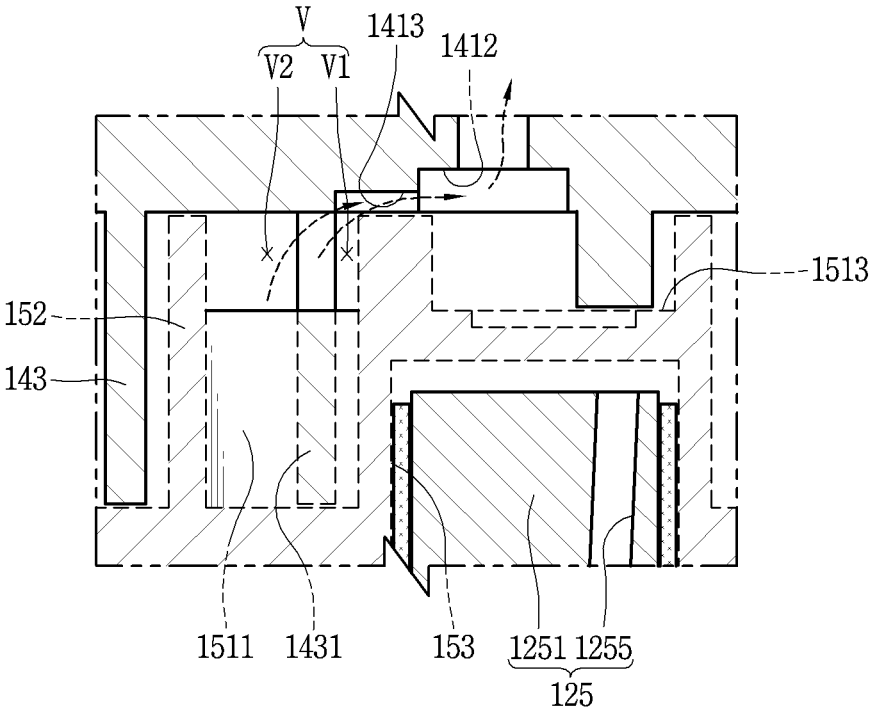
FIG. 14 is a sectional view taken along the line "XI-XI" of FIG. 13.

FIG. 12 is a perspective view illustrating another embodiment of a fixed scroll, FIG. 13 is a planar view of FIG. 12, and FIG. 14 is a sectional view taken along the line "XI-XI" of FIG. 13.

Referring to FIGS. 12 to 14, the scroll compressor according to this embodiment is the same as those of the embodiments of FIGS. 5 and 10, and the size and position of the discharge port 1412 and the position of the orbiting step surface 1511 are the same as or substantially similar to those in the embodiment of FIG. 10. Therefore, a detailed description thereof will be replaced with the description of the previous embodiment.

In this case, a connection groove 1413 may be formed in one side surface of the fixed end plate 141, that is, in a compression surface 141*a* of the fixed end plate 141 that faces the end surface of the orbiting wrap 152. For example, one end of the connection groove 1413 may be directly connected to the discharge port 1412, and another end of the connection groove 1413 may be connected to an inner surface of the fixed wrap 143, precisely, to the inner surface of the fixed wrap 143 at a discharge side rather than the fixed step surface 1431, on the basis of the fixed step surface 1431.

When the connection groove 1413 is formed in the fixed end plate 141 as described above, refrigerants can quickly move to the discharge port 1412 from the compression chambers V1 and V2 near the orbiting step surface 1511 through the connection groove 1413 even if the discharge port 1412 is spaced apart from the orbiting step surface 1511 when projected in the axial direction. Accordingly, the first compression chamber V1 (substantially, both compression chambers) and the discharge port 1412 can communicate with each other at the time when the orbiting step surface 1511 is spaced apart from the fixed step surface 1431, as in the previous embodiment. The operation effects thereof have been described above, and thus a detailed description thereof will be omitted.

Although not illustrated, the another end of the connection groove 1413 is formed as a hole that penetrates through the fixed wrap 143 or as a groove that extends across one side surface or a surface of the fixed wrap 143. However, in these cases, the rigidity of the fixed wrap 143 may be lowered, and thus the connection groove 1413 may be formed smaller than that of the previous embodiment.

Hereinafter, a description will be given of another embodiment of a rotating shaft coupling portion.

That is, in the previous embodiment, the rotating shaft coupling portion is formed to overlap the orbiting wrap in the radial direction, but in some cases, the rotating shaft coupling portion may alternatively be formed so as not to overlap the orbiting wrap in the radial direction.

Figure 15:
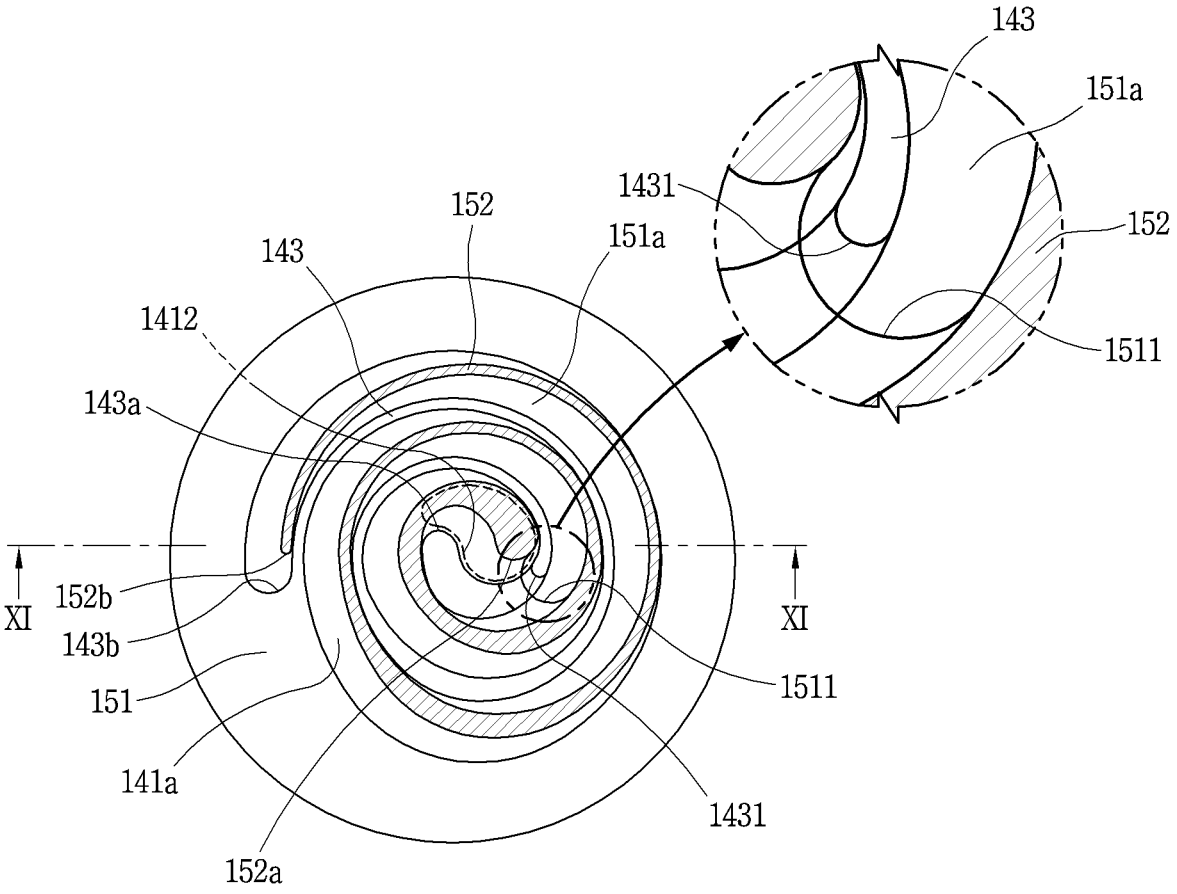
FIG. 15 is a planar view illustrating a compression part of a scroll compressor in accordance with another embodiment.
Figure 16:
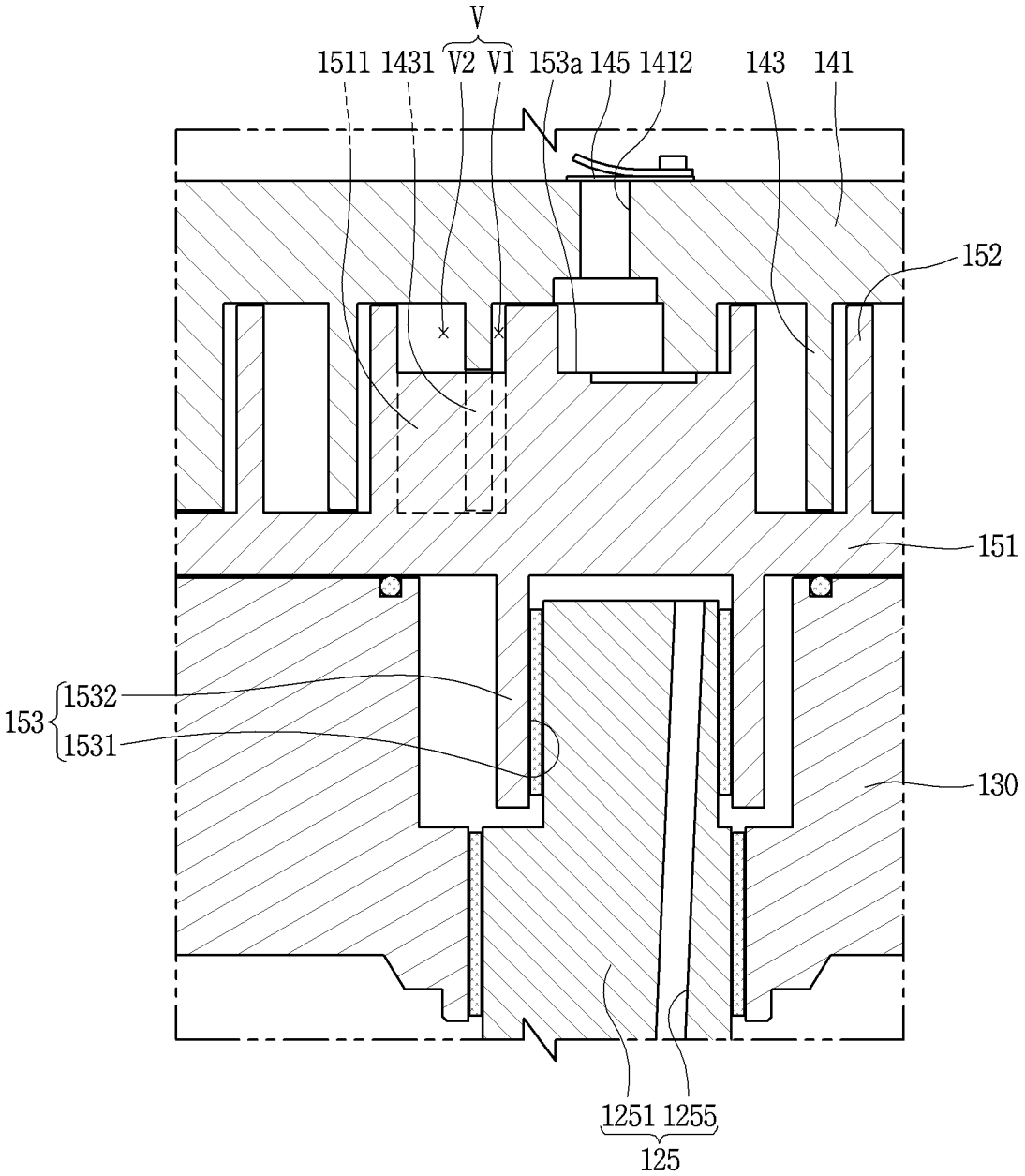
FIG. 16 is a sectional view taken along the line "XII-XII" of FIG. 15.

FIG. 15 is a planar view illustrating a compression part of a scroll compressor in accordance with another embodiment, and FIG. 16 is a sectional view taken along the line "XII-XII" of FIG. 15.

Referring to FIGS. 15 and 16, the scroll compressor according to this embodiment is similar to those in the previous embodiments in terms of the basic structure of the scroll compressor, including the fixed scroll 140 fixed to the main frame 130 and the orbiting scroll 150 coupled to the rotating shaft 125 to perform the orbiting motion relative to the fixed scroll 140.

However, in this embodiment, the rotating shaft coupling portion 153 disposed in the orbiting scroll 150 may extend in a cylindrical shape from the rear surface 151*b* of the orbiting end plate 151 toward the main frame 130. In other words, the rotating shaft coupling portion 153 according to this embodiment, unlike the previous embodiments, may extend from the compression surface of the orbiting end plate 151 merely toward the main frame 130, which is opposite to the orbiting wrap 152, not toward the fixed scroll 140. Accordingly, the eccentric portion 1251 of the rotating shaft 125 is located outside the orbiting wrap 152 in this embodiment.

Although not illustrated in the drawings, the rotating shaft coupling portion 153 may alternatively be slightly recessed from the rear surface 151*b* of the orbiting end plate 151 toward the compression surface 151*a*. However, since this embodiment is the same as the previous embodiment in terms of the fact that the rotating shaft coupling portion 153 does not overlap the orbiting wrap 152, hereinafter, an example in which the rotating shaft coupling portion 153 extends from the rear surface 151*b* of the orbiting end plate 151 toward the main frame 130 will be described.

As described above, when the rotating shaft coupling portion 153 extends only toward the rear surface 151*b* of the orbiting end plate 151, the orbiting wrap 152 and the fixed wrap 143 may have the same wrap height along the wrap formation direction. However, in this case, as described above, wrap strength of the orbiting wrap 152 and the fixed wrap 143 may be weakened in the vicinity of the discharge end 152*a* that is the central portion.

Accordingly, in this embodiment, even when the rotating shaft coupling portion 153 extends only toward the rear surface 151*b* of the orbiting end plate 151, the orbiting step surface 1511 may be formed on the compression surface 151*a* of the orbiting end plate 151 and the fixed step surface 1431 may be formed on the fixed wrap 143 corresponding to the orbiting step surface 1511. The basic shapes of the orbiting step surface 1511 and the fixed step surface 1431 and the operating effects thereof are the same as those of the previous embodiments, so a detailed description thereof will be omitted.

However, as illustrated in this embodiment, when the orbiting step surface 1511 and the fixed step surface 1431 are formed while the rotating shaft coupling portion 153 extends only toward the rear surface 151*b* of the orbiting end plate 151, the orbiting step surface 1511 and the fixed step surface 1431 may be formed closer to the discharge end 152*a*, 143*a* than the orbiting step surface 1511 and the fixed step surface 1431 of the previous embodiment.

For example, the orbiting step surface 1511 may be formed to connect the outer surface of the inner orbiting wrap 152 and the inner surface of the outer orbiting wrap 152 in the middle between the outer surface and the inner surface of the orbiting wrap 152 at the discharge end 152*a*, and the fixed end surface 1431 may be formed on the fixed wrap 143 at a position corresponding to the orbiting step surface 1511. Accordingly, since the time point at which the orbiting step surface 1511 is spaced apart from the fixed step surface 1431 is a time point after the discharging from the compression chambers V1 and V2 is started, the decrease in the compression efficiency due to the leakage between the compression chambers V1 and V2 can be more effectively suppressed.

As described above, when the rotating shaft coupling portion 153 extends from the rear surface of the orbiting end plate 151, a volume of the compression chamber V1, V2 at the discharge side can be secured, so as to suppress a drastic decrease in compression slope. This can lower a load that is applied to the fixed wrap 143 or the orbiting wrap 152.

In addition, as the rotating shaft coupling portion 153 does not overlap the orbiting wrap 152 in the radial direction, the orbiting step surface 1511 may be formed deeper toward the discharge end 152*a* of the orbiting wrap 152. Accordingly, volumetric efficiency can be enhanced by forming the discharge port 1412 to more easily communicate with the orbiting end plate 151 or making the discharge port 1412 small.

Although not illustrated, in this case, the position and shape of the discharge port 1412 may be the same as those in the previous embodiments. Even in these cases, the discharge port 1412 and the compression chambers V1 and V2 may be connected through a connection groove (not illustrated). However, in this embodiment, since the orbiting step surface 1511 is not blocked from the discharge port 1412 by the orbiting wrap 152, even when the connection groove is formed in the orbiting end plate 151, the connecting groove may be formed in a linear shape.

What is claimed is:

1. A scroll compressor comprising:

a casing;

a main frame fixed to an inside of the casing;

a rotating shaft inserted through the main frame and supported by the main frame, the rotating shaft including an eccentric portion;

an orbiting scroll including:

an orbiting end plate coupled to the eccentric portion of the rotating shaft, and an orbiting wrap extending from a first side surface of the orbiting end plate; and a fixed scroll including:

a fixed end plate defining a discharge port, and a fixed wrap extending from the fixed end plate toward the orbiting end plate and defines a compression chamber together with the orbiting wrap, wherein the orbiting scroll includes a rotating shaft coupling portion axially extending from a central portion of the orbiting end plate and radially overlapping the orbiting wrap, the rotating shaft coupling portion coupling to the eccentric portion of the rotating shaft, wherein a portion of the orbiting wrap extends from an end surface of the rotating shaft coupling portion that faces the fixed end plate, wherein an inner circumferential surface of the rotating shaft coupling portion axially overlaps a discharge end of the orbiting wrap when projected in an axial direction, wherein the orbiting end plate includes an orbiting step surface extending between (i) an outer surface of the orbiting wrap and (ii) an inner surface of the orbiting wrap, the inner surface facing the outer surface of the orbiting wrap, wherein the fixed wrap includes a fixed step surface that corresponds to the orbiting step surface, wherein the orbiting step surface and the fixed step surface are spaced apart from each other at a discharge starting angle of the compression chamber, and wherein, based on the orbiting step surface and the fixed step surface being spaced apart from each other, one end of the orbiting step surface is in fluid communication with or axially overlapped with a portion of the discharge port to thereby communicate with the portion of the discharge port at the discharge starting angle.

2. The scroll compressor of claim 1, wherein the rotating shaft coupling portion comprises:

a first coupling portion extending from the first side surface of the orbiting end plate toward the fixed scroll; and a second coupling portion connected to the first coupling portion and extending from a second side surface of the orbiting end plate toward the main frame, and wherein a height of the first coupling portion is shorter than a wrap height of the orbiting wrap located outside the rotating shaft coupling portion.

3. The scroll compressor of claim 2, wherein the height of the first coupling portion is longer than or equal to a height of the second coupling portion.

4. The scroll compressor of claim 1, wherein the discharge end of the orbiting wrap includes an arcuate portion, and wherein an outer circumferential surface of the rotating shaft coupling portion corresponds to a hypothetical circle that connects the outer surface of the orbiting wrap at the discharge end.

5. The scroll compressor of claim 1, wherein the orbiting step surface and the fixed step surface remain spaced apart from each other during a discharge stroke of the compression chamber that communicates with the orbiting end plate.

6. The scroll compressor of claim 5, wherein the orbiting step surface has a shape with an arcuate cross-section extending between (i) the outer surface of the orbiting wrap and (ii) the inner surface of the orbiting wrap that faces the outer surface, and wherein the fixed step surface has a shape with an arcuate cross-section having a curvature greater than a curvature of the orbiting step surface.

7. The scroll compressor of claim 1, wherein a wrap height of the orbiting wrap located closer to the discharge end than the orbiting step surface is smaller than a wrap height of the orbiting wrap located closer to a suction end than the orbiting step surface.

8. The scroll compressor of claim 1, wherein a wrap thickness of the orbiting wrap located closer to the discharge end than the orbiting step surface is larger than a wrap thickness of a suction end of the orbiting wrap.

9. The scroll compressor of claim 1, wherein at least one of the orbiting end plate or the fixed end plate defines a connection groove that connects the discharge port to the orbiting step surface.

10. The scroll compressor of claim 9, wherein the connection groove includes:

a first connection groove recessed at the orbiting end plate facing the discharge port in an axial direction; and a second connection groove extending from the first connection groove to the orbiting step surface, and wherein the second connection groove has a cross-sectional area that is smaller than a cross-sectional area of the first connection groove.

11. The scroll compressor of claim 9, wherein the connection groove is defined at the fixed end plate and extends from the discharge port toward an inner surface of the fixed wrap.

12. The scroll compressor of claim 1, wherein each of the fixed wrap and the orbiting wrap includes a plurality of arcuate curves that continuously connect a suction end to the discharge end.

13. A scroll compressor comprising:

a casing;

a main frame fixed to an inside of the casing;

a rotating shaft inserted through the main frame and supported by the main frame, the rotating shaft including an eccentric portion;

an orbiting scroll including:

an orbiting end plate coupled to the eccentric portion of the rotating shaft, and an orbiting wrap extending from a first side surface of the orbiting end plate; and a fixed scroll including:

a fixed end plate defining a discharge port, and a fixed wrap extending from the fixed end plate toward the orbiting end plate and defining a compression chamber together with the orbiting wrap, wherein the orbiting end plate includes an orbiting step surface extending from an outer surface of the orbiting wrap to an inner surface of the orbiting wrap, the inner surface facing the outer surface, wherein the fixed wrap includes a fixed step surface that corresponds to the orbiting step surface, wherein the orbiting step surface and the fixed step surface are configured to be spaced apart from each other based on a discharge stroke of the compression chamber, wherein a wrap height of the orbiting wrap located closer to a discharge end than the orbiting step surface is smaller than a wrap height of the orbiting wrap located closer to a suction end than the orbiting step surface, wherein a wrap height of the fixed wrap located closer to the discharge end than the fixed step surface is smaller than a wrap height of the fixed wrap located closer to the suction end than the fixed step surface, and wherein an end of the orbiting step surface is axially overlapped with a portion of the discharge port at a discharge starting angle of the compression chamber when projected in an axial direction.

14. The scroll compressor of claim 13, wherein the orbiting scroll includes a rotating shaft coupling portion that couples to the eccentric portion of the rotating shaft, and wherein the rotating shaft coupling portion extends to an opposite side of the orbiting wrap with respect to the orbiting end plate.

15. The scroll compressor of claim 14, wherein the rotating shaft coupling portion comprises:

a first coupling portion extending from the first side surface of the orbiting end plate toward the fixed scroll; and a second coupling portion connected to the first coupling portion and extending from a second side surface of the orbiting end plate toward the main frame, and wherein a height of the first coupling portion is shorter than a wrap height of the orbiting wrap located outside the rotating shaft coupling portion.

16. The scroll compressor of claim 15, wherein the height of the first coupling portion is longer than or equal to a height of the second coupling portion.

17. The scroll compressor of claim 13, wherein each of the fixed wrap and the orbiting wrap includes a plurality of arcuate curves that continuously connect the suction end to the discharge end.

* * * * *